US011737609B2

(12) United States Patent
Hong et al.

(10) Patent No.: US 11,737,609 B2
(45) Date of Patent: Aug. 29, 2023

(54) SOAP PACKAGE

(71) Applicant: The Procter & Gamble Company, Cincinnati, OH (US)

(72) Inventors: Yilin Hong, Beijing (CN); Jingtian Zeng, Zhongshan (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 17/748,790

(22) Filed: May 19, 2022

(65) Prior Publication Data

US 2022/0378255 A1 Dec. 1, 2022

(51) Int. Cl.
*A47K 5/03* (2006.01)
*B65D 75/38* (2006.01)

(52) U.S. Cl.
CPC ..... *A47K 5/03* (2013.01); *B65D 75/38* (2013.01)

(58) Field of Classification Search
CPC ..... A47K 5/03; B65D 75/38
USPC ..... 206/77.1
See application file for complete search history.

(56) References Cited

U.S. PATENT DOCUMENTS 2,491,002 A * 12/1949 Domecki ..... A47K 5/03 229/122.34
4,468,338 A 8/1984 Lindberg
4,858,757 A * 8/1989 Liggett ..... A47K 5/03 217/42
5,264,145 A 11/1993 French et al.
5,310,495 A 5/1994 Hill et al.
5,467,894 A * 11/1995 Altonen ..... B65D 5/724 221/48
5,962,382 A 10/1999 Lambino
6,152,294 A * 11/2000 Weinberg ..... A47K 5/03 206/77.1
6,297,205 B1 10/2001 Saxena et al.
7,028,835 B1 4/2006 Rajter, Jr.
2004/0055904 A1* 3/2004 Cummings ..... B65D 77/003 206/77.1
2005/0035008 A1* 2/2005 Nimmey ..... B65D 75/08 206/77.1
2011/0244887 A1 10/2011 Dupray et al.
2015/0034502 A1 2/2015 Dickinson
2019/0142226 A1* 5/2019 Teague ..... B65D 5/4279 206/77.1
2022/0202261 A1* 6/2022 Tran ..... B65D 25/10
2022/0401315 A1 12/2022 Wang et al.

FOREIGN PATENT DOCUMENTS

CH 657826 A5 9/1986
CN 201737228 U 2/2011
CN 202385925 U 8/2012
CN 204323847 U 5/2015
CN 205602286 U 9/2016
(Continued)

OTHER PUBLICATIONS

PCT Search Report and Written Opinion for PCT/CN2021/095990 dated Oct. 29, 2021, 12 pages.
(Continued)

*Primary Examiner* — Jacob K Ackun
(74) *Attorney, Agent, or Firm* — Alexandra S. Anoff

(57) ABSTRACT

A soap package that includes a cardboard box for packaging soap and a soap bar that has a narrow centered portion.

15 Claims, 21 Drawing Sheets

(56) References Cited

FOREIGN PATENT DOCUMENTS

| | | | |
|---|---|---|---|
| CN | 206954712 | U | 2/2018 |
| CN | 108438424 | A | 8/2018 |
| CN | 209492803 | U | 10/2019 |
| DE | 4414131 | A1 | 10/1995 |
| EP | 3712082 | A1 | 9/2020 |
| GB | 2456548 | A | 7/2009 |
| JP | 61038019 | U | 3/1986 |
| JP | S6335961 | A | 2/1988 |
| JP | 2007253973 | A | 10/2007 |
| JP | 4154875 | B2 | 7/2008 |
| JP | 2013107645 | A | 6/2013 |
| WO | 2007013901 | A2 | 2/2007 |
| WO | 2012136502 | A1 | 10/2012 |

OTHER PUBLICATIONS

All Office Actions; U.S. Appl. No. 17/832,784, filed Jun. 6, 2022.

* cited by examiner

SOAP PACKAGE

FIELD

The present application generally relates to a soap package that includes a cardboard box for packaging a soap and a soap bar that has a narrow centered portion. More specifically, the soap package enables easier removal of the soap from the cardboard box.

BACKGROUND

Soaps remain a popular product form for cleansing skin. Conventional packages for such soaps are well-known. A soap package usually consists of a folding box from which the soap can be removed after opening an inserted flap, the packaging then being thrown away. The soap packaging can comprise a drawer and a cover, in which the drawer is pulled out of the cover, see for instance CH 657 826 A5.

However, current dispensing packages comprising a cavity part for containing the soap do not allow the user to remove so readily the soap from the soap package. Typically, consumers shake the soap package to pour out the soap from it. As a technical solution, dimensions of the soap package could be increased to remove the soap readily. However, a relatively bigger soap package might lead to defects such as scratches during transportation.

There is still a need of an improved means for readily releasing the soap from the soap package.

SUMMARY

A soap package 1 is provided and comprises a soap 60 and a cardboard box 10 for packaging the soap 60. The box 10 comprises a front wall 11, a rear wall 12, a bottom wall 13, opposite left and right side walls, a top frame 16. The top frame 16 includes a front frame portion 16A, a rear frame portion 16B, opposite left and right front frame portions.

The box 10 comprises a longitudinal axis L, wherein the longitudinal axis L is parallel to the front and rear walls, and a transversal axis T, wherein the transversal axis T is perpendicular to the longitudinal axis L.

The box 10 comprises a cavity part 30 to include the soap 60. The cavity part 30 of the box 10 comprises an inner front wall 31, an inner rear wall 32, opposite inner left and right side walls. Optionally, the box 10 may comprise an inner peripheral bottom frame 40, wherein the inner peripheral bottom frame 40 is located in the cavity part 30 at the bottom wall 13.

The box 10 comprises first and second finger hook parts. The first finger hook part 50 is located at the inner rear wall 32 and extends from the rear wall 12, preferably from the rear frame portion 16B. The second finger hook part 51 is located at the inner front wall 31 and extends from the front wall 11, preferably from the top frame portion 16A.

The soap 60 comprises a narrow centered portion 61. The narrow centered portion 61 of the soap 60 matches with first and second finger hook parts of the box 10 to allow a user to grasp readily the soap 60 out of the box 10.

DETAILED DESCRIPTION

Definitions

Figure 1:
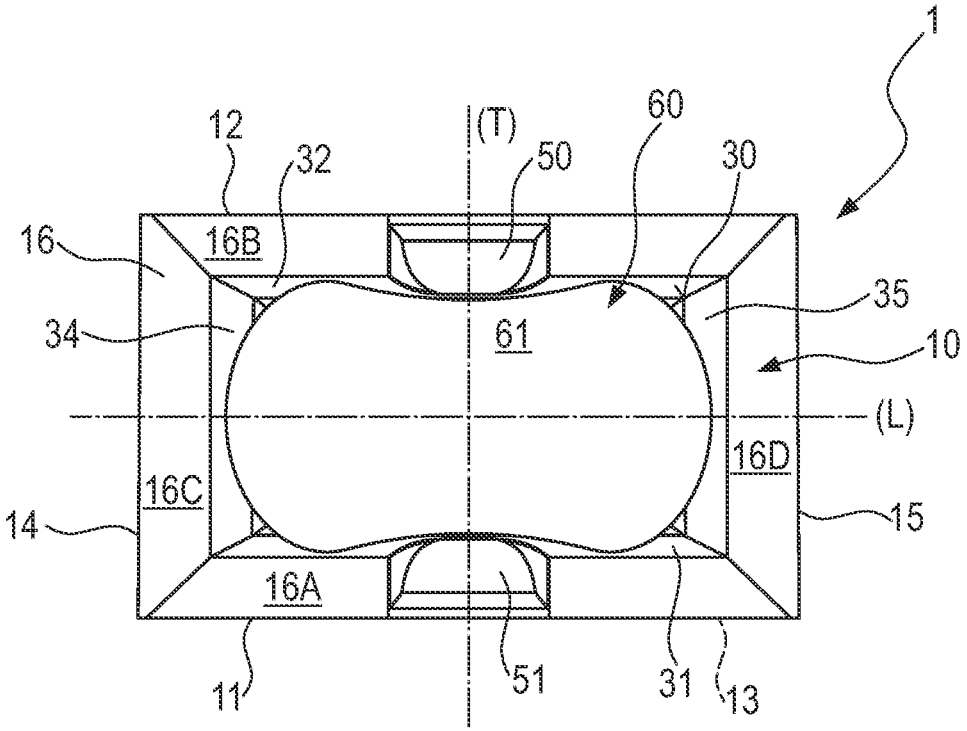
FIG. 1 provides a top view of an exemplary soap package.

In this document, including in all embodiments of all aspects of the present invention, the following definitions apply unless specifically stated otherwise.

The terms "comprise", "comprising", and "comprises" as used herein are open ended terms, each specifying the presence of what follows, e.g., a component, but not precluding the presence of other features, e.g., elements, steps or components known in the art, or disclosed herein.

The terms "include," "includes," and "including," as used herein are meant to be non-limiting.

As used herein the expressions "front", "rear", "lower", "upper", "outer", "inner", "longitudinal", "transversal", "top", "side", "bottom", "outwardly", "inwardly" and the like, when used to describe the soap package, relate to a cardboard box filled by a soap and placed in a carrying position with the bottom wall facing downwards and the top frame facing upwards, such as e.g. shown in the figures.

The term "cardboard" as used herein refers to a paperboard or carton container, or a board made of a rigid plastic material having, in combination, (and distinguishable), a top wall, a bottom wall opposite to the top wall, a front wall, and a rear wall opposite to the front wall, and opposite left and right side walls that collectively enclose and protect an interior space that is usable for packing, storing, shipping, and/or merchandizing a soap. For the cardboard box disclosed herein, and for most cardboards in general, a bottom wall is recognized as the side of the cardboard box that is intuitively placed on a surface when the cardboard box is to remain stationary and a top wall of the cardboard box is the location of an opening/access to the cardboard box. The cardboard box may be made of a paperboard, coated paperboard that is coated with a natural or synthetic waterproof or water resistant material such as polyethylene or other synthetic or natural polymers, wax, other suitable materials or blends thereof.

The term "blank" as used herein refers to a term of art in the packaging industry that refers to a flat board/sheet that is cut to a pattern that may be erected into a cardboard box structure. A "blank" may be a flat piece of corrugated board (paperboard, cardboard) or a flat piece made of a rigid plastic material that has various cut lines and fold lines such that a machine (called a conversion machine or a carton erector) can build it into a three-dimensional carton. Such blanks may also be cut with perforated lines that may outline locations where the erected box can be opened at a future time.

The term "arc-shaped notch" as used herein refers to a notch comprising an arc, preferably a circular arc. An arc is any smooth curve joining two points. Preferably, an arc is any portion other that the entire curve of the circumference of a circle.

The term "lower arc-shaped notch" as used herein refers to an arc having an orientation toward the bottom wall.

The objects of the present invention are to provide dispensing soap packages for a packaging a soap, as described in the Summary or as described hereinbelow for fulfilling the technical effects or goals as set out herein. These objects and other advantages as may be apparent to those skilled in the art can be achieved through the present invention, which is described in the above Summary of the Invention and Detailed Description of the invention and which is defined in the claims which follow.

Soap Package

FIG. 1 shows a soap package 1 within the scope of the invention. The soap package 1 comprises a cardboard box 10 and a soap 60.

Figure 2:
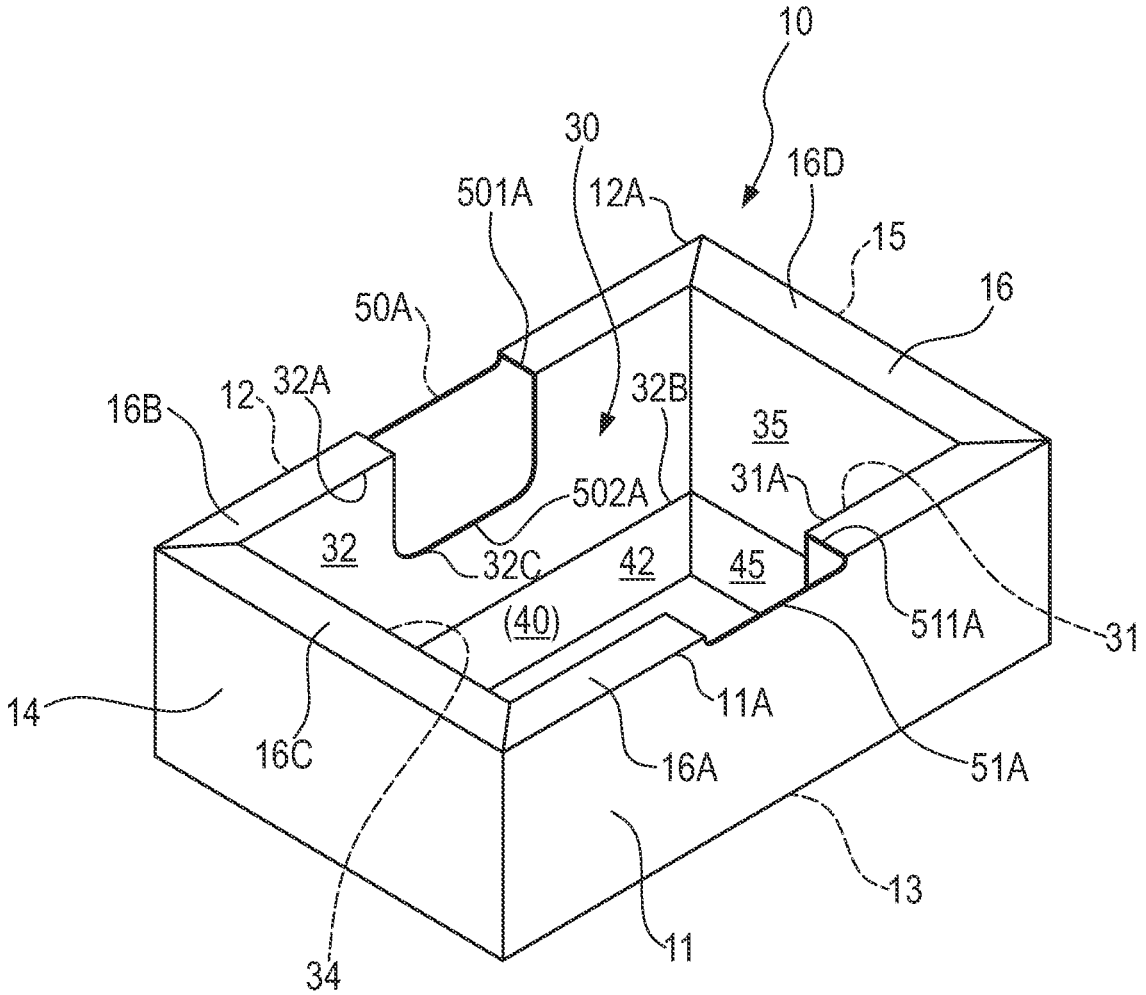
FIG. 2 provides a perspective view of an exemplary cardboard box.

The cardboard box 10 for packaging the soap 60 has approximately a parallelepiped-shape, i.e. a hexahedron shape. FIG. 2 shows a schematic perspective view of a cardboard box 10 according to one or more aspects.

The cardboard box 10 comprises a front wall 11, a rear wall 12, a bottom wall 13, opposite left and right side walls (14, 15), and a top frame 16. The top frame 16 includes a front frame portion 16A, a rear frame portion 16B, opposite left and right front frame portions (16C, 16D).

The cardboard box 10 comprises a longitudinal axis L. The longitudinal axis L is parallel to the front and rear walls (11, 12). The cardboard box 10 also comprises a transversal axis T, wherein the transversal axis T is perpendicular to the longitudinal axis L.

The cardboard box 10 comprises a cavity part 30 to include the soap 60. The cavity part 30 of the cardboard box 10 comprises an inner front wall 31, an inner rear wall 32, opposite inner left and right side walls (34, 35).

Optionally, the box 10 may comprise an inner peripheral bottom frame 40, wherein the inner peripheral bottom frame 40 is located in the cavity part 30 at the bottom wall 13.

The cardboard box 10 comprises first and second finger hook parts (50, 51). The first finger hook part 50 is located at the inner rear wall 32.

The first finger hook part 50 extends from the rear wall 12, preferably from the rear frame portion 16B, more preferably from the rear frame portion 16B to the bottom wall 13, even more preferably from a portion of the rear frame portion 16B to a portion of the inner rear wall 32.

The second finger hook part 51 is located at the inner front wall 31.

The second finger hook part 51 extends from the front wall 11, preferably from the top frame portion 16A, more preferably from the top frame portion 16A to the bottom wall 13, even more preferably from a portion of the front frame portion 16A to a portion of the inner front wall 31.

The soap package 1 includes a soap 60 comprising a narrow centered portion 61.

The narrow centered portion 61 of the soap 60 may be defined as the centered region of the soap 60 extending along the longitudinal axis L and having a relatively narrow width as measured in the transversal direction perpendicular to the longitudinal axis L.

The narrow centered portion 61 of the soap 60 matches with first and second finger hook parts (50, 51) of the cardboard box 10 to allow a user to grasp readily the soap 60 out of the cardboard box 10. Because the narrow centered portion 61 of the soap 60 coincides with first and second finger hook parts (50, 51), the user can readily grasp the soap 60 from the cavity part 30 of the cardboard box 10, and this without having to shake the soap package 1 to pour out the soap 60 from the cardboard box 10.

The first and second finger hook parts (50, 51) may be symmetrical to each other along the longitudinal axis L, as shown in a FIG. 1. In that case, the first and second finger hook parts (50, 51) are of the same nature, namely the same structure.

Alternatively, the first and second finger hook parts (50, 51) may be different, however may be still located on the transversal axis T. In that case, even if the first and second finger hook parts (50, 51) are different, the first and second finger hook parts (50, 51) still match with the narrow centered portion 61 of the soap 60. It could be advantageous to have first and second finger hook parts (50, 51) that differ from each other to get a better grip of the soap 60.

The soap 60 does not need to have a symmetrical narrow centered portion 61 along the longitudinal axis L. Slightly deformed narrow centered portions 61 of the soap 60 could be contemplated. In those cases, and in a general manner, one or both of the first and second finger hook parts (50, 51) may be located on or adjacent to the transversal axis T. The first and second finger hook part (50, 51) may be the same or different.

The Blank in a Flat-Shape

A blank 100 is provided and has a substantially flat-shape. The blank 100 is able to be converted in the cardboard box 10 having a substantially parallelepiped-shape.

Figure 3:
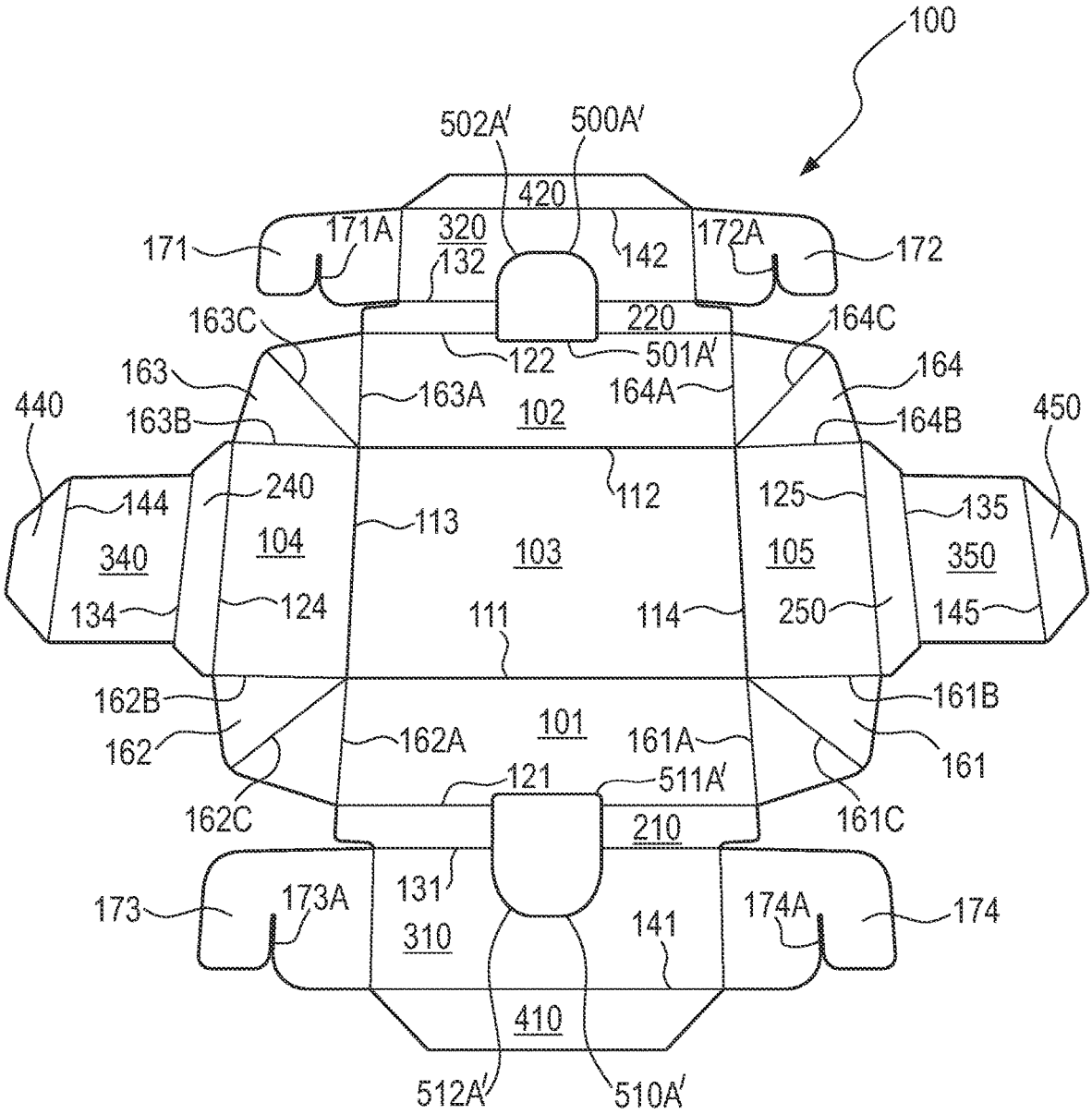
FIG. 3 provides a front view of the blank for the cardboard box of FIG. 2.

FIG. 3 provides a front view of an indicative example of a blank 100 having a substantially flat-shape leading to the cardboard box of FIG. 2.

The description of the blank 100 hereinbelow is applicable to any aspects of the cardboard box 10.

The blank 100 includes a front panel 101 to form the front wall 11, a rear panel 102 to form the rear wall 12, wherein the front panel 101 is opposite to the rear panel 102.

The blank 100 includes a bottom panel 103 to form the bottom wall 13, opposite left and right panels (104, 105) to form the respective opposite left and right side walls (14, 15).

Thus, when the blank 100 is folded into the cardboard box 10, the blank 100 comprises a front wall 11, a rear wall 12, a bottom wall 13, opposite left and right side walls (14, 15).

The blank 100 also comprises opposite outer left and right panels (340, 350) to form the respective opposite inner left and right side walls (34, 35), opposite outer upper and lower panels (320, 310) to form respectively the inner rear wall 32 and the inner rear front 31.

Thus, when the blank 100 is folded in the cardboard box 10, the blank 100 comprises the cavity part 30 of the cardboard box 10 having an inner front wall 31, an inner rear wall 32, opposite inner left and right side walls (34, 35).

As shown in a FIG. 3 for instance, the bottom panel 103 and the front panel 101 are connected at a first fold line 111. The bottom panel 103 and the rear panel 102 are connected at a second fold line 112. The bottom panel 103 and the left panel 104 are connected at a third fold line 113. The bottom panel 103 and the right panel 105 are connected at a fourth fold line 114.

The left panel 104 has a flap 240 opposite to the bottom panel 103 and connected to the left panel 104 at a fifth fold line 124. The outer left panel 340 is connected to the flap 240 of the left panel 104 at a sixth fold line 134. The flap 240 of the left panel 104 forms the left frame portion 16C of the top frame 16.

Likewise, the right panel 105 has a flap 250 opposite to the bottom panel 103 and connected to the right panel 105 at a seventh fold line 125. The outer right panel 350 is connected to the flap 250 of the right panel 105 at an eighth fold line 135. The flap 250 of the right panel 105 forms the right frame portion 16D of the top frame 16.

The third, fourth, fifth, sixth, seventh and eighth fold lines (113, 114, 124, 134, 125, 135) are parallel lines.

The front panel 101 has also a flap 210 opposite to the bottom panel 103 and connected to the front panel 101 at a ninth fold line 121. The outer lower panel 310 is connected to the flap 210 of the front panel 101 at a tenth fold line 131. The flap 210 of the front panel 101 forms the front frame portion 16A of the top frame 16.

Similarly, the rear panel 102 has a flap 220 opposite to the bottom panel 103 and connected to the rear panel 102 at an eleventh fold line 122. The outer upper panel 320 is connected to the flap 220 of the rear panel 102 at a twelfth fold line 132. The flap 220 of the rear panel 102 forms the rear frame portion 16B of the top frame 16.

The first, second, ninth, tenth, eleventh and twelfth fold lines (111, 112, 121, 131, 122, 132) are parallel lines.

Thus, when the blank 100 is folded into the cardboard box 10, the blank 100 comprises a top frame 16 that includes a front frame portion 16A, a rear frame portion 16B, opposite left and right front frame portions (16C, 16D).

Advantageously, the blank 100 may further include first, second, third and fourth continuous pieces (161, 162, 163, 164). Such continuous pieces can help to stiffen the cardboard box 10 and close up the edges of the cardboard box 10 to render it hermetic to the external environment. Such continuous pieces can help to protect the soap from any dust coming from these edges.

The first continuous piece 161 connects the front panel 101 and the right panel 105 with two respective fold lines (161A, 161B). The first continuous piece 161 has a 45-degree valley fold line 161C between the front panel 101 and the right panel 105.

The second continuous piece 162 connects the front panel 101 and the left panel 104 with two respective fold lines (162A, 162B). The second continuous piece 162 has a 45-degree valley fold line 162C between the front panel 101 and the left panel 104.

The third continuous piece 163 connects the rear panel 102 and the left panel 104 with two respective fold lines (163A, 163B). The third continuous piece 163 has a 45-degree valley fold line 163C between the rear panel 102 and the left panel 104.

The fourth continuous piece 164 connects the rear panel 102 and the right panel 105 with two respective fold lines (164A, 164B). The fourth continuous piece 164 has a 45-degree valley fold line 164C between the rear panel 102 and the right panel 105.

Also, the blank 100 may further include two pairs of opposite left and right fitting pieces (171, 172; 173, 174) for better assembling opposite outer upper and lower panels (320, 310) to consolidate the final structure of the cardboard box 10.

The blank 100 may further include at each of the opposite outer upper and lower panels (320, 310), two respective opposite left and right fitting pieces (171, 172; 173, 174). Each of the respective opposite left and right fitting pieces (171, 172; 173, 174) comprises an insertion slot (171A, 172A; 173A, 174A) such that when the blank 100 is folded into the box 10:

The left fitting piece 171 of the outer upper panel 320 connects with the left fitting piece 173 of the outer lower panel 310 by inserting the insertion slot 171A of the left fitting piece 171 of the outer upper panel 320 into the insertion slot 173A of the left fitting piece 173 of the outer lower panel 310.

Likewise, the right fitting piece 172 of the outer upper panel 320 connects with the right fitting piece 174 of the outer lower panel 310, by inserting the insertion slot 172A of the right fitting piece 172 of the outer upper panel 320 into the insertion slot 174A of the right fitting piece 174 of the outer lower panel 310.

Optionally, the box 10 may comprise an inner peripheral bottom frame 40, wherein the inner peripheral bottom frame 40 is located in the cavity part 30 at the bottom wall 13.

The side of the inner peripheral bottom frame 40 facing the bottom wall 13 may be attached to the bottom wall 13 to secure further the overall structure of the folded blank 100 into the cardboard box 10. Such attachment may be typically provided with an adhesive, or a uniform continuous layer of adhesive, or a patterned layer of adhesive, or an array of separate lines, spirals, or spots of adhesive.

For providing the inner peripheral bottom frame 40, the outer left panel 340 may have a folding locking piece 440 to form a left tongue portion 44 of the inner peripheral bottom frame 40. The folding locking piece 440 is connected at the outer left panel 340 at a fold line 144.

The outer right panel 350 may have a folding locking piece 450 to form a right tongue portion 45 of the inner peripheral bottom frame 40. The folding locking piece 450 is connected at the outer right panel 350 at a fold line 145.

The outer lower panel 310 may have a folding locking piece 410 to form a front tongue portion 41 of the inner peripheral bottom frame 40. The folding locking piece 410 is connected at the outer lower panel 310 at a fold line 141.

The outer upper panel 320 may have a folding locking piece 420 to form a rear tongue portion 42 of the inner peripheral bottom frame 40. The folding locking piece 420 is connected at the outer upper panel 320 at a fold line 142.

Thus, when the blank 100 is folded into the cardboard box 10, the blank 100 may comprise an inner peripheral bottom frame 40 that includes a front tongue portion 41, a rear tongue portion 42, opposite left and right tongue portions (43, 44).

First and Second Hook Parts

In a first aspect, as shown in a FIG. 2 for instance, the first finger hook part 50A may be an aperture formed by a complete rectangular notch 501A and a complete lower arc-shaped notch 502A. The complete rectangular notch 501A of the first finger hook part 50A may be provided on a portion of the rear wall 12 and the rear frame portion 16B. Preferably, the complete rectangular notch 501A of the first finger hook part 50A may be provided only on a portion of the rear frame portion 16B. More preferably, the complete rectangular notch 501A of the first finger hook part 50A may be provided only on a portion of the rear frame portion 16B extending from an upper longitudinal edge 12A of the rear wall 12 to an upper longitudinal edge 32A of the inner rear wall 32.

The complete lower arc-shaped notch 502A of the first finger hook part 50A may be provided on a portion of the inner rear wall 32. The complete lower arc-shaped notch 502A of the first finger hook part 50A comprises an arc having an orientation toward the bottom wall 13.

Preferably, the complete lower arc-shaped notch 502A of the first finger hook part 50A may be provided on a portion of the inner rear wall 32 extending from the upper longitudinal edge 32A of the inner rear wall 32 to a lower longitudinal level 32C of the inner rear wall 32. The lower longitudinal level 32C of the inner rear wall 32 is upper than a lower longitudinal edge 32B of the inner rear wall 32. The lower longitudinal level 32C of the inner rear wall 32 coincides with a tangent of the arc of the complete lower arc-shaped notch 502A.

The complete rectangular notch 501A at the rear frame portion 16B is connected to the complete lower arc-shaped notch 502A at the inner rear wall 32. In other words, the complete rectangular notch 501A is connected to the complete lower arc-shaped notch 502A at the upper longitudinal edge 32A of the inner rear wall 32.

The upper longitudinal edge 32A of the inner rear wall 32 coincides with an inner longitudinal edge of the rear frame portion 16B. The upper longitudinal edge 12A of the rear wall 12 coincides with an outer longitudinal edge of the rear frame portion 16B.

The second finger hook part 51A may be an aperture formed by a complete rectangular notch 511A and a complete lower arc-shaped notch 512A. The complete rectangular notch 511A of the second finger hook part 51A may be provided on a portion of the top wall 11 and the top frame portion 16A. Preferably, the complete rectangular notch 511A of the second finger hook part 51A may be provided only on a portion of the top frame portion 16A. More preferably, the complete rectangular notch 511A of the second finger hook part 51A may be provided only on a portion of the top frame portion 16A extending from an upper longitudinal edge 11A of the front wall 11 to an upper longitudinal edge 31A of the inner front wall 31.

The complete lower arc-shaped notch 512A of the second finger hook part 51A may be provided on a portion of the inner front wall 31. The complete lower arc-shaped notch 512A of the second finger hook part 51A comprises an arc having an orientation toward the bottom wall 13.

Preferably, the complete lower arc-shaped notch 512A of the second finger hook part 51A may be provided on a portion of the inner front wall 31 extending from the upper longitudinal edge 31A of the inner front wall 31 to a lower longitudinal level (31C, not shown) of the inner front wall 31. The lower longitudinal level 31C of the inner front wall 31 is upper than a lower longitudinal edge (31B, not shown) of the inner front wall 31. The lower longitudinal level 31C of the inner front wall 31 coincides with a tangent of the arc of the complete lower arc-shaped notch 512A.

The complete rectangular notch 511A at the top frame portion 16A is connected to the complete lower arc-shaped notch 512A of the inner front wall 31. In other words, the complete rectangular notch 511A is connected to the complete lower arc-shaped notch 512A at the upper longitudinal edge 31A of the inner front wall 31.

The upper longitudinal edge 31A of the inner front wall 31 coincides with an inner longitudinal edge of the top frame portion 16A. The upper longitudinal edge 11A of the front wall 11 coincides with an outer longitudinal edge of the top frame portion 16A.

The soap 60 can apply some pressure on the inner front wall 31 and inner rear wall 32. At the location of the first and second finger hook parts (50A, 51A), opposing forces having substantially the same direction parallel to the transversal axis T can be exerted to prevent any deformation of the cardboard box 10.

When the first and second finger hook parts (50A, 51A) have the structure as described just above, the forces are better distributed through the first and second finger hook parts (50A, 51A). The cardboard box 10 can be slightly deformed to endure any forces exerted by the soap 60 to front and rear inner walls (32, 32) in the cavity part 30.

For providing the first aspect, as shown in a FIG. 3 for instance, the blank 100 may include a first aperture 500A' to form the first finger hook part 50A. The first aperture 500A' may be a cutting notch formed by a complete rectangular notch 501A' and a complete lower arc-shaped notch 502A'.

The complete rectangular notch 501A' of the first aperture 500A' may be provided at a portion of the rear panel 102 and a portion of the flap 220 of the rear panel 102. Preferably, the complete rectangular notch 501A' of the first aperture 500A' may be provided only at a portion of the flap 220 of the rear panel 102 extending from the eleventh fold line 122 of the rear panel 102 to the twelfth fold line 132 of the outer upper panel 320.

The complete lower arc-shaped notch 502A' of the first aperture 500A' may be provided on a portion of the outer upper panel 320. The complete lower arc-shaped notch 502A' of the first aperture 500A' comprises an arc having an opposite direction to the bottom panel 103.

The complete rectangular notch 501A' at the flap 220 of the rear panel 102 is connected to the complete lower arc-shaped notch 502A' at the outer upper panel 320. In other words, the complete rectangular notch 501A' is connected to the complete lower arc-shaped notch 502A' at the twelfth fold line 132 of the outer upper panel 320.

The blank 100 may include a second aperture 510A' to form the second finger hook part 51A. The second aperture 510A' may be a cutting notch formed by a complete rectangular notch 511A' and a complete lower arc-shaped notch 512A'.

The complete rectangular notch 511A' of the second aperture 510A' may be provided at a portion of the front panel 101 and a portion of the flap 210 of the front panel 101. Preferably, the complete rectangular notch 511A' of the second aperture 510A' may be provided only at a portion of the flap 210 of the front panel 101 extending from the ninth fold line 121 of the front panel 101 to the tenth fold line 131 of the outer lower panel 310.

The complete lower arc-shaped notch 512A' of the second aperture 510A' may be provided on a portion of the outer lower panel 310. The complete lower arc-shaped notch 512A' of the second aperture 510A' comprises an arc having an opposite direction to the bottom panel 103.

The complete rectangular notch 511A' at the flap 210 of the front panel 101 is connected to the complete lower arc-shaped notch 512A' at the outer lower panel 310. In other words, the complete rectangular notch 511A' is connected to the complete lower arc-shaped notch 512A' at the tenth fold line 131 of the outer lower panel 310.

Figure 4:
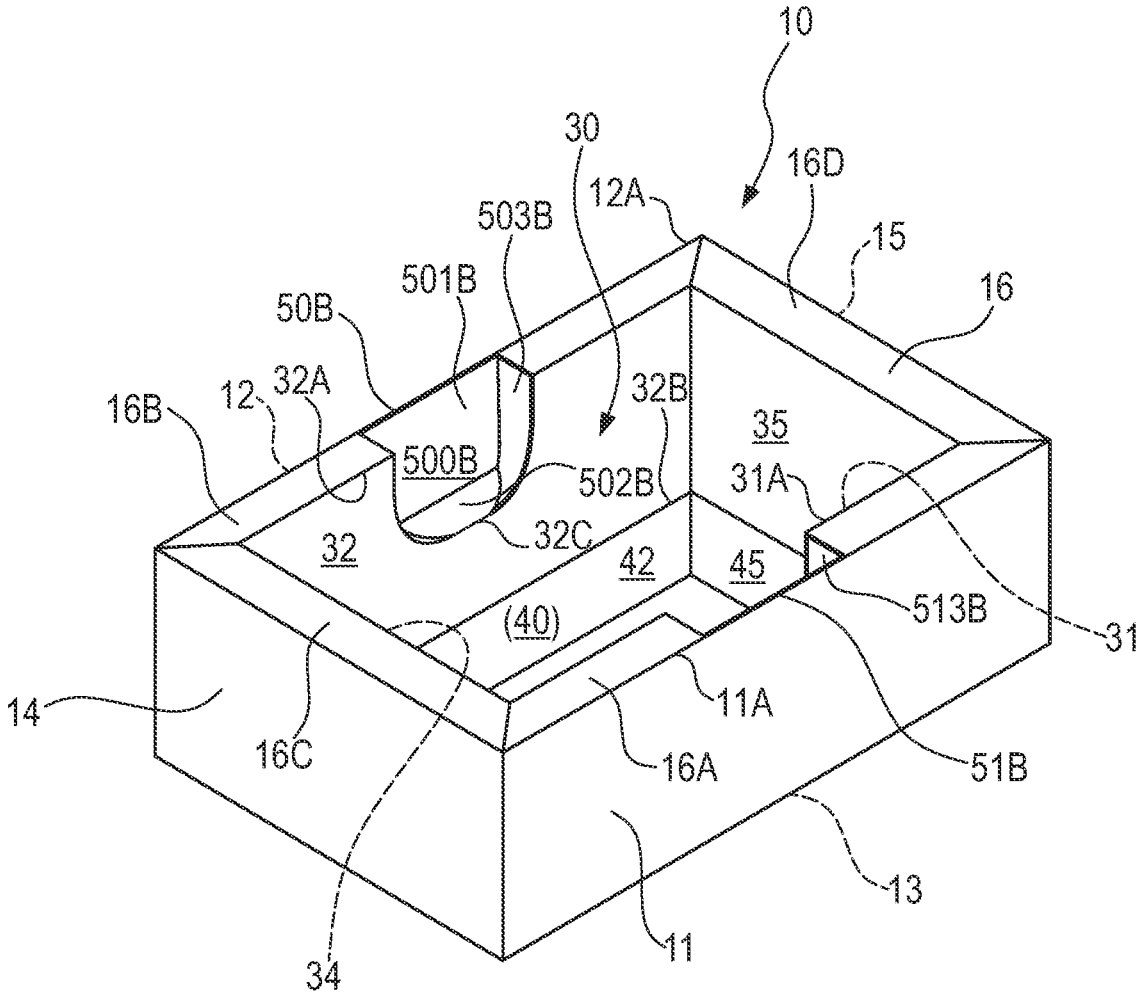
FIG. 4 provides a perspective view of another exemplary cardboard box.

Alternatively, in a second aspect, as shown in a FIG. 4 for instance, the first finger hook part 50B may comprise a cutting notch 503B and a reflexed cutout 500B. The reflexed cutout 500B may comprise upper and lower cutout portions (501B, 502B).

The upper cutout portion 501B of the first finger hook part 50B may be formed by a rectangular notch provided on a portion of the rear frame portion 16B. Preferably, the upper cutout portion 501B of the first finger hook part 50B may be formed by a rectangular notch provided on a portion of the rear frame portion 16B extending from an upper longitudinal edge 12A of the rear wall 12 to an upper longitudinal edge 32A of the inner rear wall 32.

The lower cutout portion 502B of the first finger hook part 50B may be formed by a lower arc-shaped notch provided on a portion of the inner rear wall 32.

Preferably, the lower cutout portion 502B of the first finger hook part 50B may be formed by a lower arc-shaped notch provided on a portion of the inner rear wall 32 extending from the upper longitudinal edge 32A of the inner rear wall 32 to a lower longitudinal level 32C of the inner rear wall 32. The lower longitudinal level 32C of the inner rear wall 32 is upper than a lower longitudinal edge 32B of the inner rear wall 32. The lower longitudinal level 32C of the inner rear wall 32 coincides with a tangent of the arc of the lower arc-shaped notch.

The upper cutout portion 501B and lower cutout portion 502B may be connected as a whole. Preferably, the two ends of the respective upper and lower cutout portions (501B, 502B) may be connected with the rectangular notch provided on the portion of the rear frame portion 16B and the lower arc-shaped notch provided on the portion of the inner rear wall 32.

In other words, an uppermost end of the upper cutout portion 501B may be connected to the rectangular notch at the upper longitudinal edge 12A of the rear wall 12.

A lowermost end of the lower cutout portion 502B may be connected to a lowermost edge of the lower arc-shaped notch on the portion of the inner rear wall 32 towards the bottom wall 13. The lowermost edge of the lower arc-shaped notch coincides with the lower longitudinal level 32C of the inner rear wall 32.

The second finger hook part 51B may comprise a cutting notch 513B and a reflexed cutout 510B. The reflexed cutout 510B may comprise upper and lower cutout portions (511B, 512B).

The upper cutout portion 511B of the second finger hook part 51B may be formed by a rectangular notch provided on a portion of the front frame portion 16A.

Preferably, the upper cutout portion 511B of the second finger hook part 51B may be formed by a rectangular notch provided on a portion of the front frame portion 16A extending from an upper longitudinal edge 11A of the front wall 11 to an upper longitudinal edge 31A of the inner front wall 31.

The lower cutout portion 512B of the second finger hook part 51B may be formed by a lower arc-shaped notch provided on a portion of the inner front wall 31.

Preferably, the lower cutout portion 512B of the second finger hook part 51B may be formed by a lower arc-shaped notch provided on a portion of the inner front wall 31 extending from the upper longitudinal edge 31A of the inner front wall 31 to a lower longitudinal level (31C, not shown) of the inner front wall 31. The lower longitudinal level 31C of the inner front wall 31 is upper than a lower longitudinal edge (31B, not shown) of the inner front wall 31. The lower longitudinal level 31C of the inner front wall 31 coincides with a tangent of the arc of the lower arc-shaped notch.

The upper cutout portion 511B and lower cutout portion 512B may be connected as a whole. Preferably, the two ends of the respective upper and lower cutout portions (511B, 512B) may be connected with the rectangular notch provided on the portion of the top frame portion 16A and the lower arc-shaped notch provided on the portion of the inner front wall 32.

In other words, an uppermost end of the upper cutout portion 511B may be connected to the rectangular notch at an upper longitudinal edge 11A of the front wall 11.

A lowermost end of the lower cutout portion 512B may be connected to a lowermost edge of the lower arc-shaped notch on the portion of the inner front wall 31 towards the bottom wall 13. The lowermost edge of the lower arc-shaped notch coincides with the lower longitudinal level 31C of the inner front wall 31.

The soap 60 can apply some pressure on the inner front wall 31 and inner rear wall 32. At the location of the first and second finger hook parts (50B, 51B), opposing forces having substantially the same direction parallel to the transversal axis T can be exerted to prevent any deformation of the cardboard box 10.

When the first and second finger hook parts (50B, 51B) have the structure as described just above, the forces are also better distributed through the first and second finger hook parts (50B, 51B). The reflexed cutouts (500B, 510B) of the first and second finger hook parts (50B, 51B) can also help to better match the contours of the fingers of the user to grasp even more readily the soap 60 from the cardboard box 10.

Figure 5:
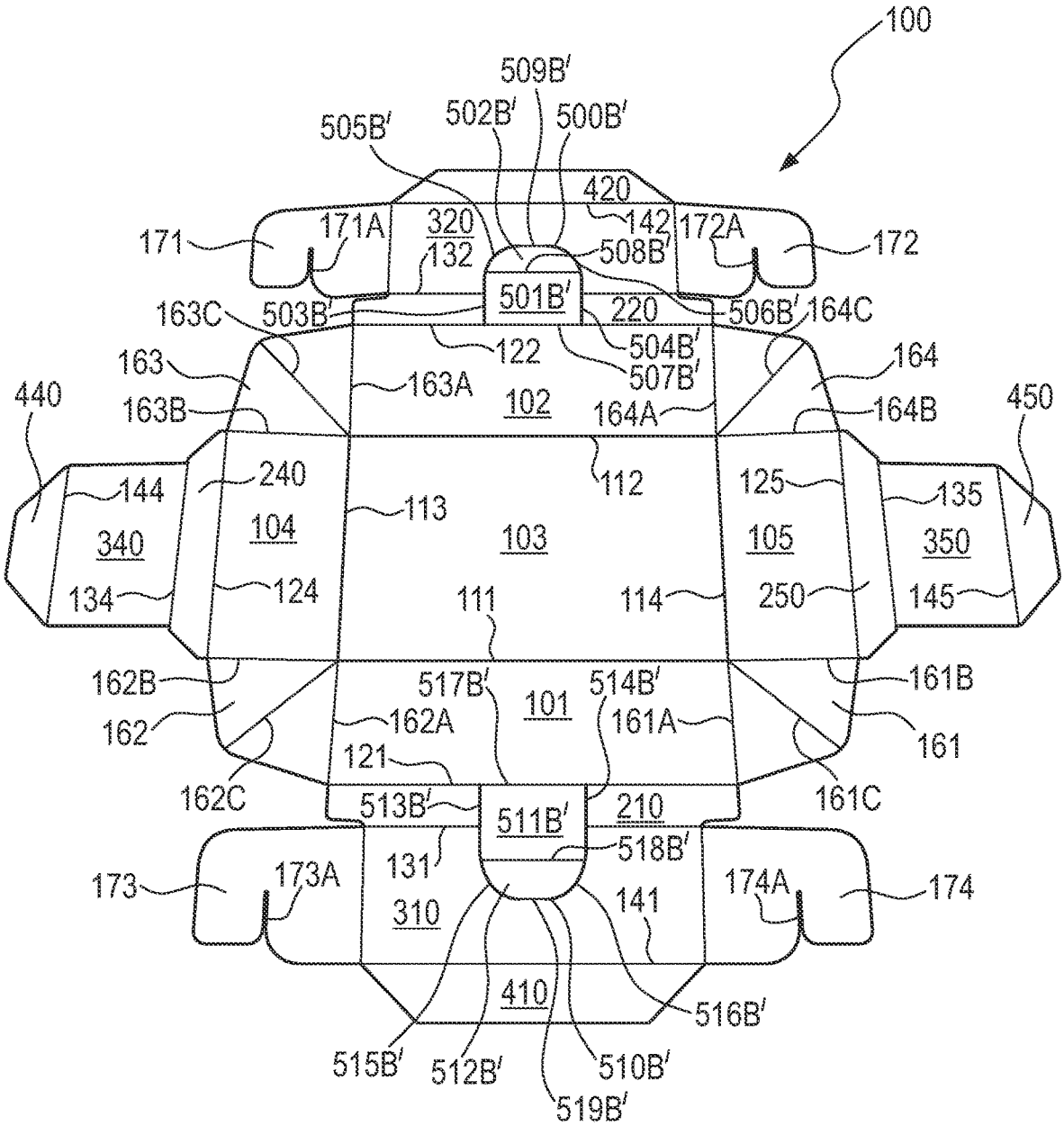
FIG. 5 provides a front view of the blank for the cardboard box of FIG. 4.

For providing the second aspect, as shown in a FIG. 5 for instance, the blank 100 may include a first cutout 500B' to form the first finger hook part 50B. The first cutout 500B' may include first and second cutout portions (501B', 502B').

The first cutout portion 501B' may be formed by cutting two parallel line segments (503B', 504B') both extending and perpendicular from the eleventh fold line 122 of the rear panel 102 to a portion of the outer upper panel 320.

The second cutout portion 502B' may be formed by cutting two opposite arcs (505B', 506B') extending from the respective parallel line segments (503B', 504B') at the outer upper panel 320.

The first cutout 500B' may comprise first, second and third fold lines (507B', 508B', 509B'). The first fold line 507B' of the first cutout 500B' may be coincident to the eleventh fold line 122 of the rear panel 102.

The second fold line 508B' of the first cutout 500B' may connect the two parallel line segments (503B', 504B'). Especially, the second fold line 508B' of the first cutout 500B' may connect the two parallel line segments (503B', 504B') when the two opposite arcs (505B', 506B') connect with the respective two parallel line segments (503B', 504B').

The third fold line 509B' of the first cutout 500B' may connect the two opposite arcs (505B', 506B').

The first fold line 507B' may be parallel to the second and third fold lines (508B', 509B') of the first cutout 500B'.

Preferably, along the line segment 503B' of the first cutout portion 501B', the distance between the third fold line 509B' and second fold line 508B' is equal to the distance between the twelfth fold line 132 of the outer upper panel 320 and the eleventh fold line 122 of the rear panel 102.

The blank (100) may also include a second cutout 510B' to form the second finger hook part 51B. The second cutout 510B' may include first and second cutout portions (511B', 512B').

The first cutout portion 511B' may be formed by cutting two parallel line segments (513B', 514B') both extending and perpendicular from the ninth fold line 121 of the front panel 101 to a portion of the outer lower panel 310.

The second cutout portion 512B' may be formed by cutting two opposite arcs (515B', 516B') extending from the respective parallel line segments (513B', 514B') at the outer lower panel 310.

The second cutout 510B' may comprise first, second and third fold lines (517B', 518B', 519B'). The first fold line 517B' of the second cutout 510B' may be coincident to the ninth fold line 121 of the front panel 101.

The second fold line 518B' of the second cutout 510B' may connect the two parallel line segments (513B', 514B'). Especially, the second fold line 518B' of the second cutout 510B' may connect the two parallel line segments (513B', 514B') when the two opposite arcs (515B', 516B') connect with the respective two parallel line segments (513B', 514B').

The third fold line 519B' of the second cutout 510B' may connect the two opposite arcs (515B', 516B').

The first fold line 517B' may be parallel to the second and third fold lines (518B', 519B') of the second cutout (510B').

Preferably, along the line segment 513B' of the first cutout portion 511B', the distance between the third fold line 519B' and second fold line 518B' is equal to the distance between the tenth fold line 131 of the outer lower panel 310 and the ninth fold line 121 of the front panel 101.

Figure 6:
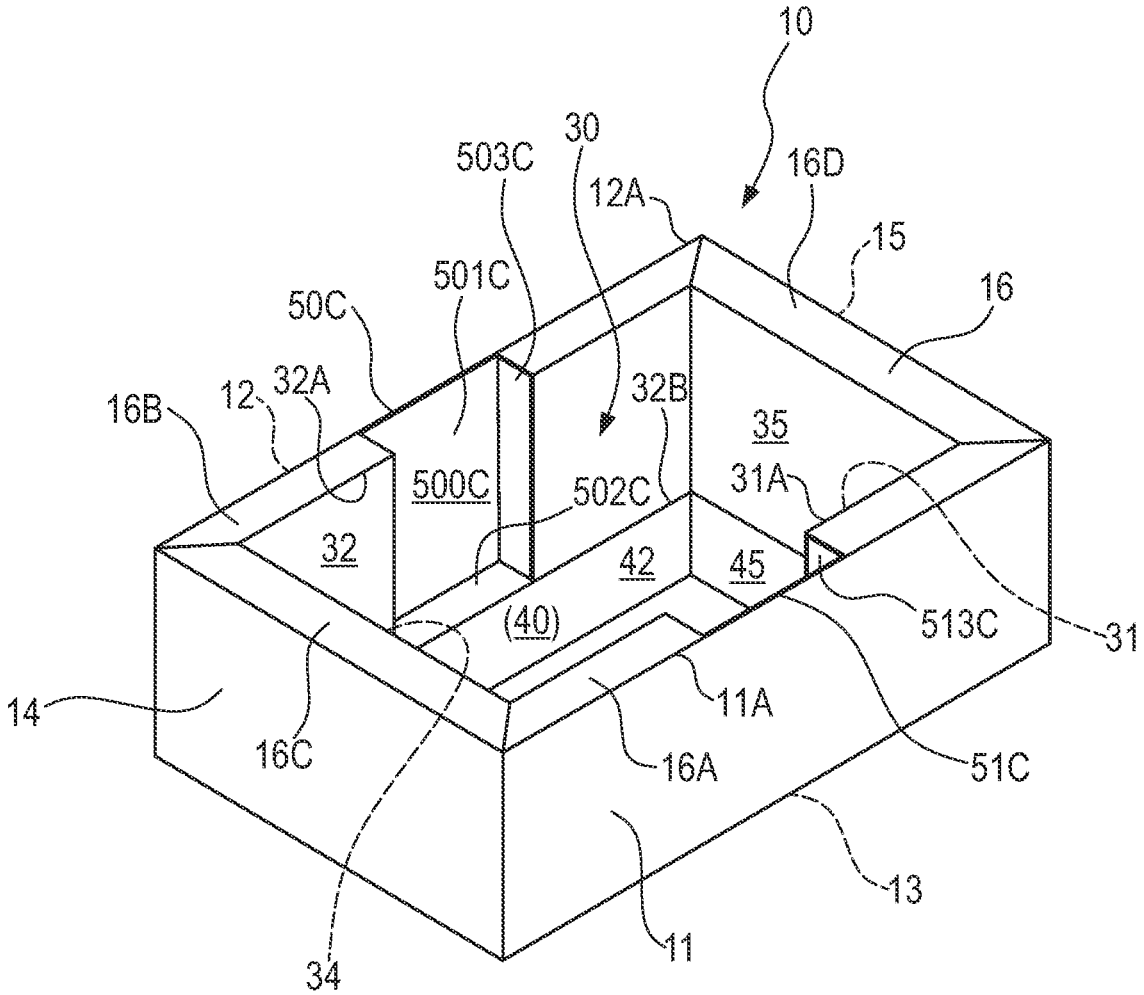
FIG. 6 provides a perspective view of another exemplary cardboard box.

Alternatively, in a third aspect, as shown in a FIG. 6 for instance, the first finger hook part 50C may comprise a cutting notch 503C and a reflexed cutout 500C. The reflexed cutout 500C may comprise upper and lower cutout portions (501C, 502C).

The upper cutout portion 501C of the first finger hook part 50C may be formed by a rectangular notch provided on a portion of the rear frame portion 16B. Preferably, the upper cutout portion 501C of the first finger hook part 50C may be formed by a rectangular notch provided on a portion of the rear frame portion 16B extending from an upper longitudinal edge 12A of the rear wall 12 to an upper longitudinal edge 32A of the inner rear wall 32.

The lower cutout portion 502C of the first finger hook part 50C may be formed by a rectangular notch provided on a portion of the inner rear wall 32 extending from the upper longitudinal edge 32A to a lower longitudinal edge 32B of the inner rear wall 32. The upper cutout portion 501C and lower cutout portion 502C are connected as a whole.

Preferably, the two ends of the respective upper and lower cutout portions (501C, 502C) may be connected with the respective rectangular notches provided on the respective portions of the rear frame portion 16B and the inner rear wall 32.

In other words, an uppermost end of the upper cutout portion 501C may be connected to the rectangular notch at the upper longitudinal edge 12A of the rear wall 12. A lowermost end of the lower cutout portion 502C may be connected the rectangular notch at the lower longitudinal edge 32B of the inner rear wall 32.

The second finger hook part 51C may comprise a cutting notch 513C and a reflexed cutout 510C. The reflexed cutout 510C may comprise upper and lower cutout portions (511C, 512C).

The upper cutout portion 511C of the second finger hook part 51C may be formed by a rectangular notch provided on a portion of the front frame portion 16A. Preferably, the upper cutout portion 511C of the second finger hook part 51C may be formed by a rectangular notch provided on a portion of the front frame portion 16A extending from an upper longitudinal edge 11A of the front wall 11 to an upper longitudinal edge 31A of the inner front wall 31.

The lower cutout portion 512C of the second finger hook part 51C may be formed by a rectangular notch provided on a portion of the inner front wall 31 extending from the upper longitudinal edge 31A to a lower longitudinal edge (31B, not shown) of the inner front wall 31. The upper cutout portion 511C and lower cutout portion 512C are connected as a whole.

Preferably, the two ends of the respective upper and lower cutout portions (511C, 512C) are connected with the respective rectangular notches provided on the respective portions of the top frame portion 16A and the inner front wall 32.

In other words, an uppermost end of the upper cutout portion 511C may be connected to the rectangular notch at the upper longitudinal edge 11A of the front wall 11. A lowermost end of the lower cutout portion 512C may be connected the rectangular notch at the lower longitudinal edge 31B of the inner front wall 31.

The soap 60 can apply some pressure on the inner front wall 31 and inner rear wall 32. At the location of the first and second finger hook parts (50C, 51C), opposing forces having substantially the same direction parallel to the transversal axis T can be exerted to prevent any deformation of the cardboard box 10.

When the first and second finger hook parts (50C, 51C) have the structure as described just above, the forces are better distributed through the first and second finger hook parts (50C, 51C). The cardboard box 10 can be slightly deformed to endure any forces exerted by the soap 60 to front and rear inner walls (32, 32) in the cavity part 30.

Figure 7:
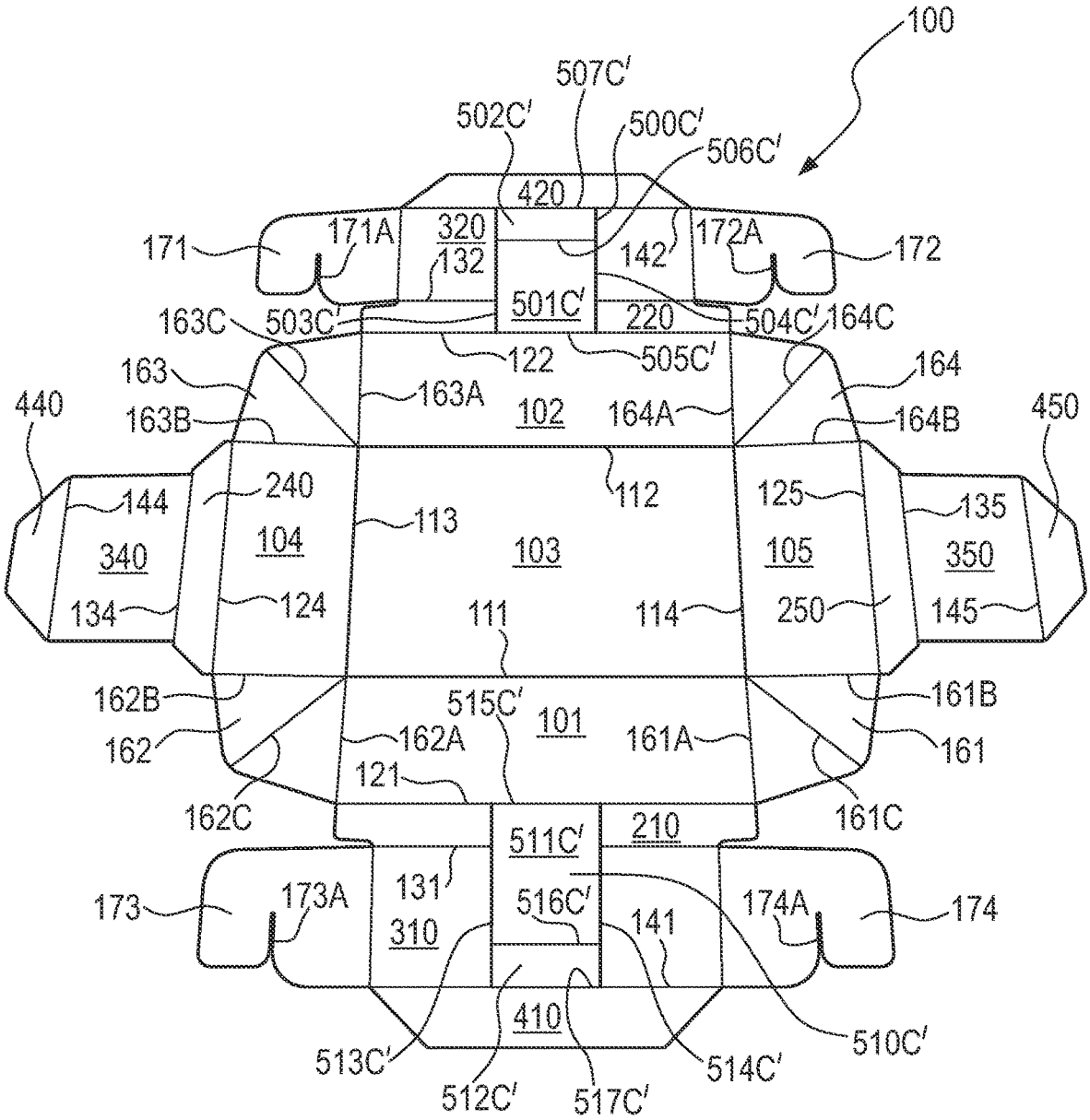
FIG. 7 provides a front view of the blank for the cardboard box of FIG. 6.

For providing the third aspect, as shown in a FIG. 7 for instance, the blank 100 may include a first cutout 500C' to form the first finger hook part 50C. The first cutout 500C' may include first and second cutout portions (501C', 502C').

First and second cutout portions (501C', 502C') may be formed by cutting two parallel line segments (503C', 504C') both extending and perpendicular from the eleventh fold line 122 of the rear panel 102 to an opposite edge of the outer upper panel 320. The opposite edge of the outer upper panel 320 is the edge opposite to the twelfth fold line 132 of the outer upper panel 320.

Preferably, first and second cutout portions (501C', 502C') may be formed by cutting two parallel line segments (503C', 504C') both extending and perpendicular from the eleventh fold line 122 of the rear panel 102 to the fold line 142 of the folding locking piece 420 of the outer upper panel 320.

The first cutout 500C' may comprise first, second and third fold lines (505C', 506C', 507C'). The first fold line 505C' of the first cutout 500C' may be coincident to the eleventh fold line 122 of the rear panel 102.

The second fold line 506C' of the first cutout 500C' may connect first and second cutout portions (501C', 502C').

The third fold line 507C' of the first cutout 500C' may be coincident to the opposite edge of the outer upper panel 320. Preferably, the third fold line 507C' of the first cutout 500C' may be coincident to the fold line 142 of the folding locking piece 420 of the outer upper panel 320.

The first fold line 505C' is parallel to the second and third fold lines (506C', 507C') of the first cutout 500C'.

Preferably, along the line segment 503C' of the first cutout portion 501C', the distance between the third fold line 507C' and second fold line 506C' is equal to the distance between the twelfth fold line 132 of the outer upper panel 320 and the eleventh fold line 122 of the rear panel 102.

The blank 100 may include a second cutout 510C' to form the second finger hook part 51C. The second cutout 510C' may include first and second cutout portions (511C', 512C').

The second cutout portion 511B' may be formed by cutting two parallel line segments (513C', 514C') both extending and perpendicular from the ninth fold line 121 of the front panel 101 to an opposite edge of the outer lower panel 310. The opposite edge of the outer lower panel 310 coincides with the tenth fold line 131 of the outer lower panel 310.

Preferably, the second cutout portion 511B' may be formed by cutting two parallel line segments (513C', 514C') both extending and perpendicular from the ninth fold line 121 of the front panel 101 to the fold line 141 of the folding locking piece 410 of the outer lower panel 310.

The second cutout 510C' may comprise first, second and third fold lines (515B', 516B', 517B'). The first fold line 515B' of the second cutout 510C' may be coincident to the ninth fold line 121 of the front panel 101.

The second fold line 516C' of the second cutout 510C' may connect first and second cutout portions (511C', 512C').

The third fold line 517C' of the second cutout 510C' may be coincident to the opposite edge of the outer lower panel 310. Preferably, the third fold line 517C' of the second cutout 510C' may be coincident to the fold line 141 of the folding locking piece 410 of the outer lower panel 310.

The first fold line 515C' is parallel to the second and third fold lines (516C', 517C') of the second cutout 510C'.

Preferably, along the line segment 513C' of the first cutout portion 511C', the distance between the third fold line 517C' and second fold line 516C' is equal to the distance between the tenth fold line 131 of the outer lower panel 310 and the ninth fold line 121 of the front panel 101.

Figure 8:
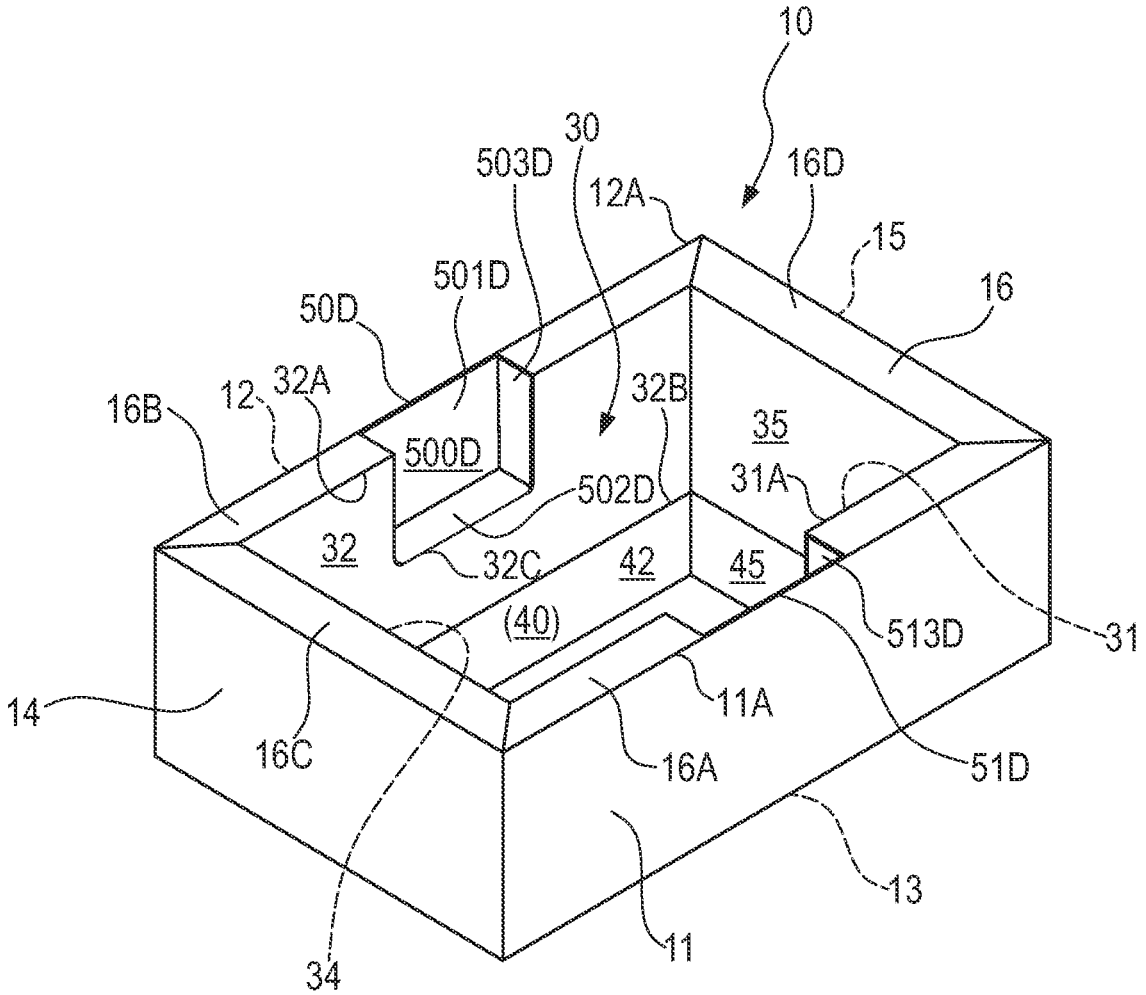
FIG. 8 provides a perspective view of another exemplary cardboard box.

Alternatively, in a fourth aspect, as shown in a FIG. 8 for instance, the first finger hook part 50D may comprise a cutting notch 503D and a reflexed cutout 500D. The reflexed cutout 500D may comprise upper and lower cutout portions (501D, 502D).

The upper cutout portion 501D of the first finger hook part 50D may be formed by a rectangular notch provided on a portion of the rear frame portion 16B. Preferably, the upper cutout portion 501D of the first finger hook part 50D may be formed by a rectangular notch provided on a portion of the rear frame portion 16B extending from an upper longitudinal edge 12A of the rear wall 12 to an upper longitudinal edge 32A of the inner rear wall 32.

The lower cutout portion 502D of the first finger hook part 50D may be formed by a rectangular notch provided on a portion of the inner rear wall 32.

Preferably, the lower cutout portion 502D of the first finger hook part 50D may be formed by a rectangular notch provided on a portion of the inner rear wall 32 extending from the upper longitudinal edge 32A to a lower longitudinal level 32C of the inner rear wall 32. The lower longitudinal level 32C of the inner rear wall 32 is upper than the lower longitudinal edge 32B of the inner rear wall 32.

The upper cutout portion 501D and lower cutout portion 502D are connected as a whole.

Preferably, the two ends of the respective upper and lower cutout portions (501D, 502D) may be connected with the respective tops of the rectangular notches provided on the respective portions of the rear frame portion 16B and the inner rear wall 32.

In other words, an uppermost end of the upper cutout portion 501D may be connected to the rectangular notch at the upper longitudinal edge 12A of the rear wall 12.

A lowermost end of the lower cutout portion 502D may be connected to the lower longitudinal level 32C of the inner rear wall 32.

The second finger hook part 51D may comprise a cutting notch 513D and a reflexed cutout 510D. The reflexed cutout 510D may comprise upper and lower cutout portions (511D, 512D).

The upper cutout portion 511D of the second finger hook part 51D may be formed by a rectangular notch provided on a portion of the front frame portion 16A. The lower cutout portion 512D of the second finger hook part 51D may be formed by a rectangular notch provided on a portion of the inner front wall 31. Preferably, the upper cutout portion 511D of the second finger hook part 51D may be formed by a rectangular notch provided on a portion of the front frame portion 16A extending from an upper longitudinal edge 11A of the front wall 11 to an upper longitudinal edge 31A of the inner front wall 31.

Preferably, the lower cutout portion 512D of the second finger hook part MD may be formed by a rectangular notch provided on a portion of the inner front wall 31 extending from an upper longitudinal edge 31A to a lower longitudinal level (31C, not shown) of the inner front wall 31. The lower longitudinal level (31C, not shown) of the inner front wall 31 is upper than the lower longitudinal edge (31B, not shown) of the inner front wall 31.

The upper cutout portion 511D and lower cutout portion 512D are connected as a whole.

Preferably, the two ends of the respective upper and lower cutout portions (511D, 512D) may be connected with the respective tops of the rectangular notches provided on the respective portions of the top frame portion 16A and the inner front wall 32.

In other words, an uppermost end of the upper cutout portion 511D may be connected to the rectangular notch at the upper longitudinal edge 11A of the front wall 11.

A lowermost end of the lower cutout portion 512D may be connected to the lower longitudinal level 31C of the inner front wall 31.

The soap 60 can apply some pressure on the inner front wall 31 and inner rear wall 32. At the location of the first and second finger hook parts (50D, 51D), opposing forces having substantially the same direction parallel to the transversal axis T can be exerted to prevent any deformation of the cardboard box 10.

When the first and second finger hook parts (50D, 51D) have the structure as described just above, the forces are also better distributed through the first and second finger hook parts (50D, 51D). The reflexed cutouts (500D, 510D) of the first and second finger hook parts (50D, 51D) can also help to better match the contours of the fingers of the user to grasp even more readily the soap 60 from the cardboard box 10.

Figure 9:
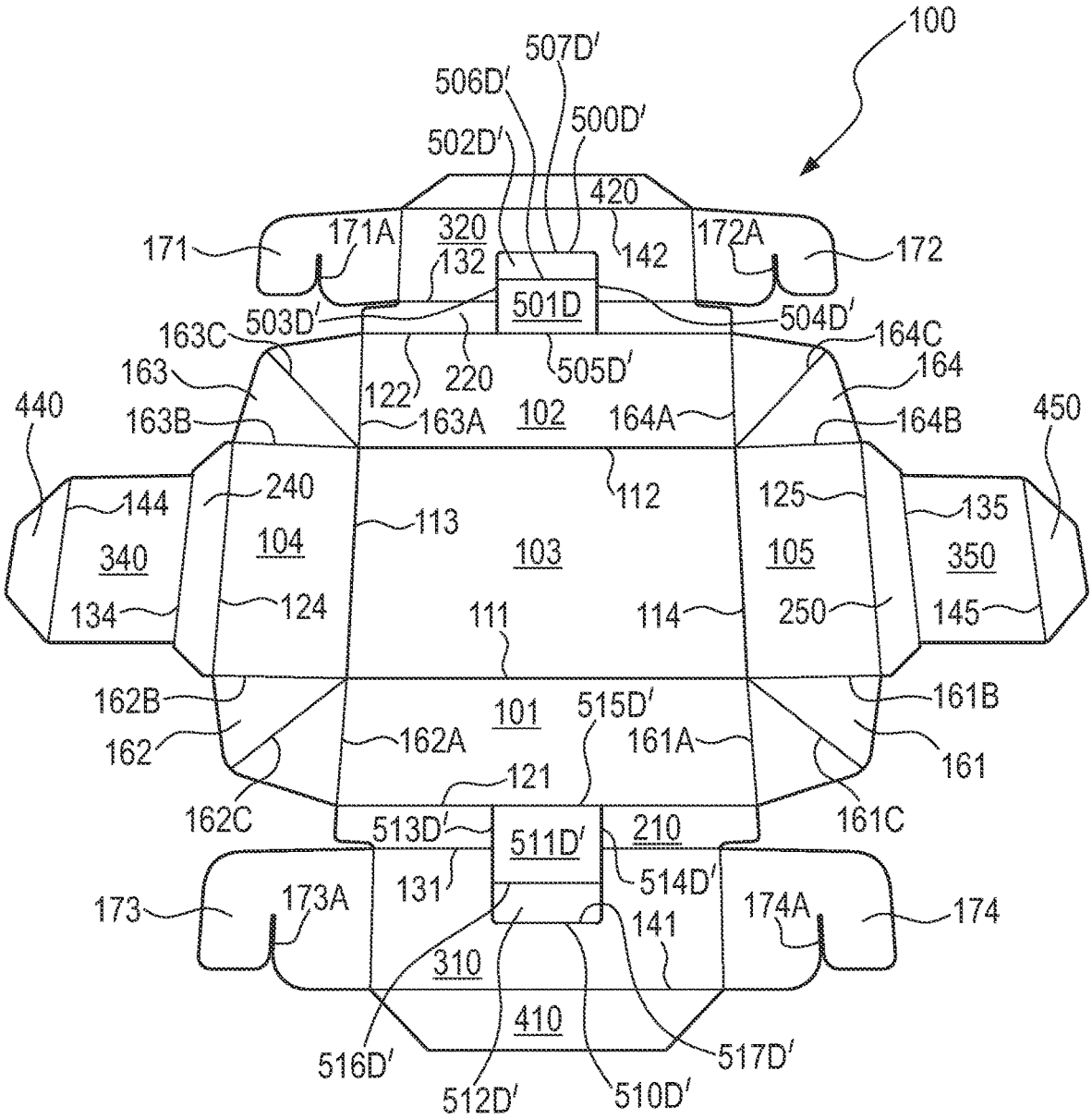
FIG. 9 provides a front view of a blank for the cardboard box of FIG. 8.

For providing the third aspect, as shown in a FIG. 9 for instance, the blank 100 may include a first cutout 500D' to form the first finger hook part 50D. The first cutout 500D' may include first and second cutout portions (501D', 502D').

First and second cutout portions (501D', 502D') may be formed by cutting two parallel line segments (503D', 504D') both extending and perpendicular from the eleventh fold line 122 of the rear panel 102 to a portion of the outer upper panel 320.

The first cutout 500D' may comprise first, second and third fold lines (505D', 506D', 507D'). The first fold line 505D' of the first cutout 500D' may be coincident to the eleventh fold line 122 of the rear panel 102.

The second fold line 506D' of the first cutout 500D' may connect first and second cutout portions (501D', 502D').

The third fold line 507D' of the first cutout 500D' may be an outmost edge of the second cutout portion 502D'.

The first fold line 505D' is parallel to the second and third fold lines (506D', 507D') of the first cutout 500D'.

Preferably, along the line segment 503D' of the first cutout portion 501D', the distance between the third fold line 507D' and second fold line 506D' is equal to the distance between the twelfth fold line 132 of the outer upper panel 320 and the eleventh fold line 122 of the rear panel 102.

The blank 100 may include a second cutout 510D' to form the second finger hook part 51D. The second cutout 510D' may include first and second cutout portions (511D', 512D').

The second cutout portion 511D' may be formed by cutting two parallel line segments (513D', 514D') both extending and perpendicular from the ninth fold line 121 of the front panel 101 to a portion of the outer lower panel 310.

The second cutout 510D' may comprise first, second and third fold lines (515D', 516D', 517'D'). The first fold line 515D' of the second cutout 510D' may be coincident to the ninth fold line 121 of the front panel 101.

The second fold line 516D' of the second cutout 510D' may connect first and second cutout portions (511D', 512D').

The third fold line 517D' of the second cutout 510D' may be an outmost edge of the second cutout portion 512D' of the outer lower panel 310.

The first fold line 515D' is parallel to the second and third fold lines (516D', 517D') of the second cutout 510D'.

Preferably, along the line segment 513D' of the first cutout portion 511D', the distance between the third fold line 517D' and second fold line 516D' is equal to the distance between the tenth fold line 131 of the outer lower panel 310 and the ninth fold line 121 of the front panel 101.

Folding Methodology

FIGS. 10-14 illustrate how a blank 100 may be typically folded into the cardboard box 10.

Figure 10:
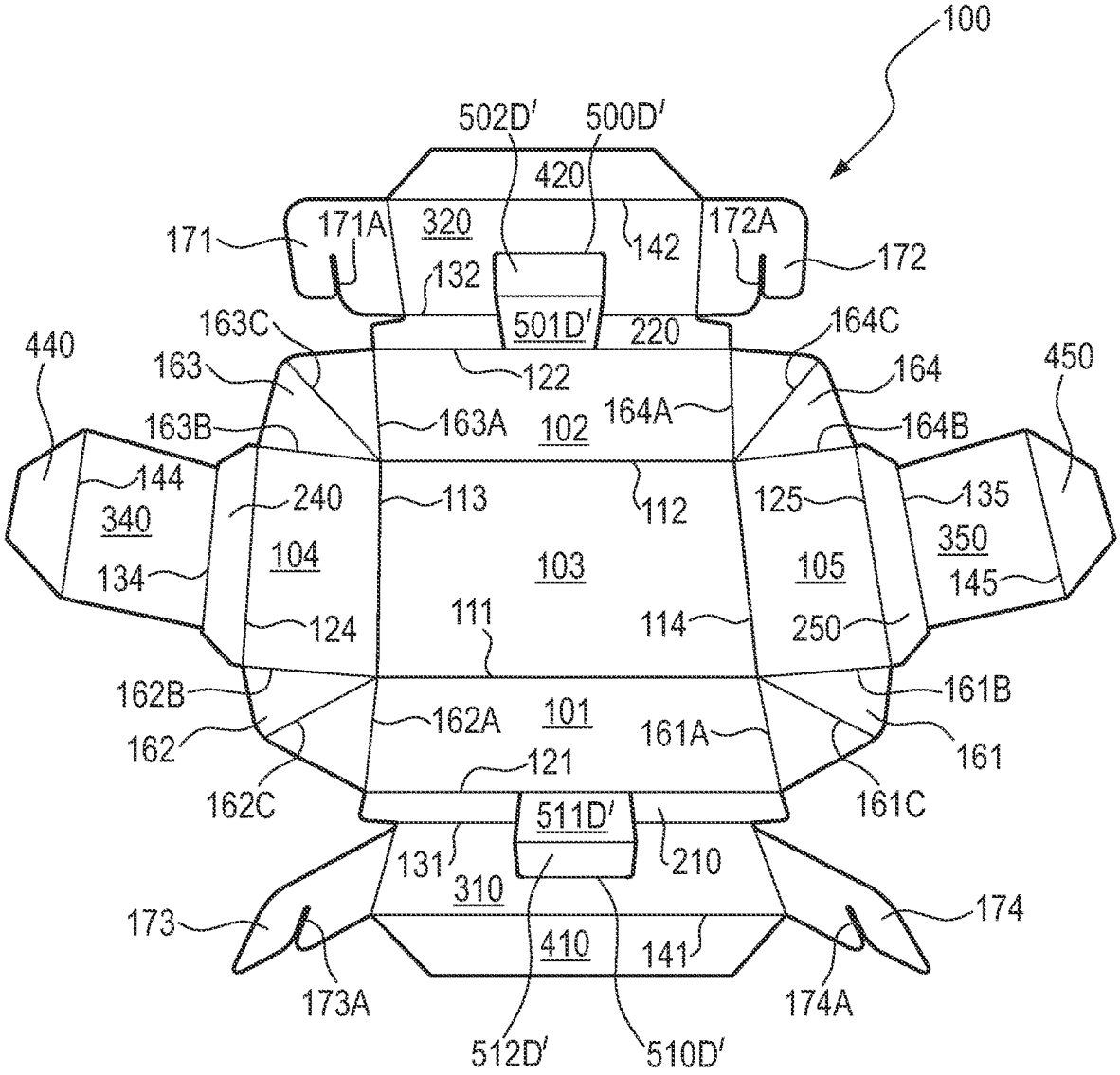
FIG. 10 provides a front view of the partially folded blank of FIG. 9.
Figure 11:
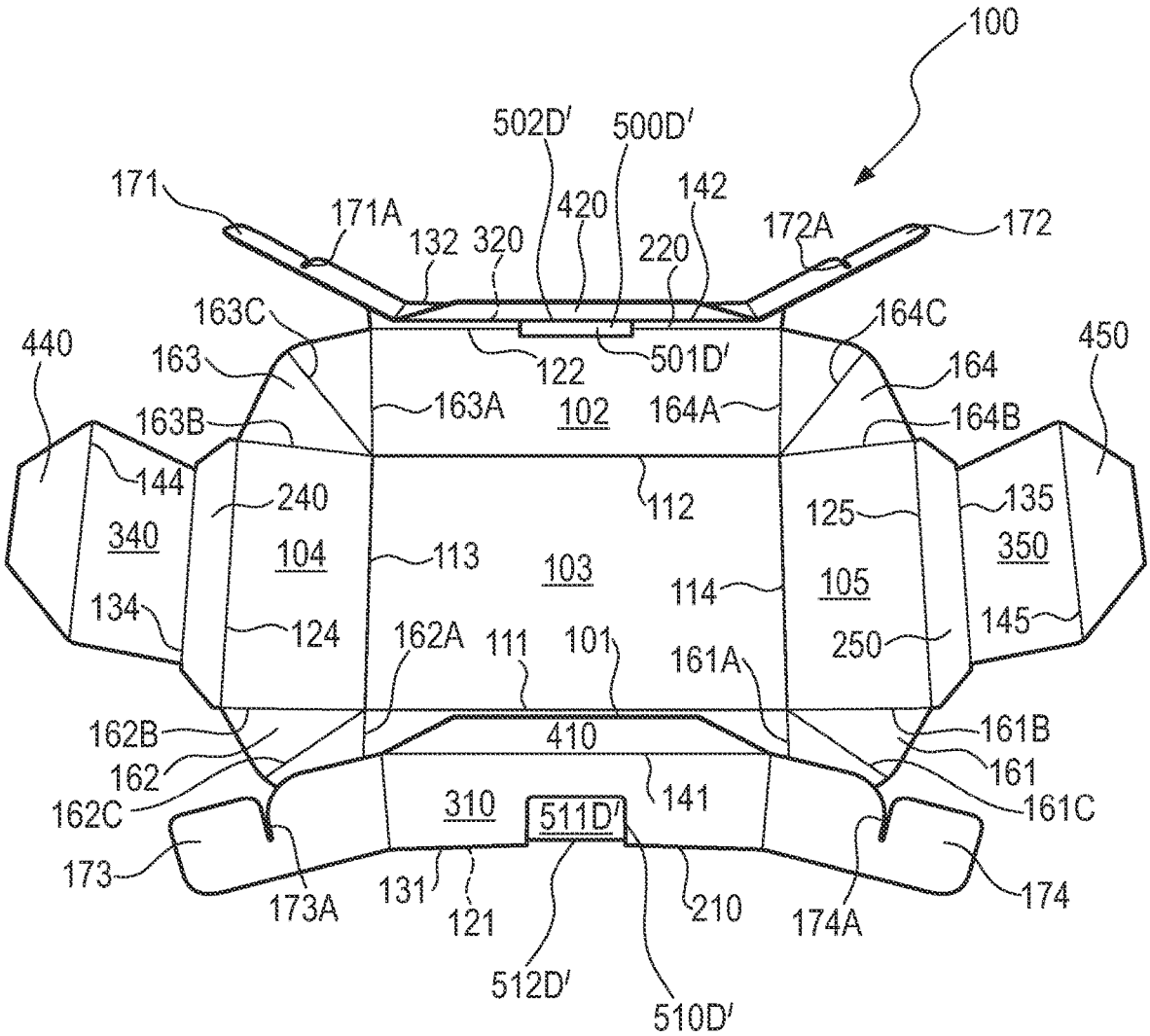
FIG. 11 provides a front view of the partially folded blank of FIG. 9.

As a first step, as shown in FIG. 10 and FIG. 11, the outer upper panel 320 needs to be folded onto the rear panel 102 by folding the eleventh fold line 122 of the rear panel 102 and the twelfth fold line 132 of the outer upper panel 320. The outer lower panel 310 also needs to be folded onto the front panel 101 by folding the ninth fold line 121 of the front panel 101 and the tenth fold line 131 of the outer lower panel 310. The folding steps of the outer upper panel 320 and outer lower panel 310 lead to any structures of first and second hook parts (50, 51) accordingly as set out hereinbefore.

Figure 12:
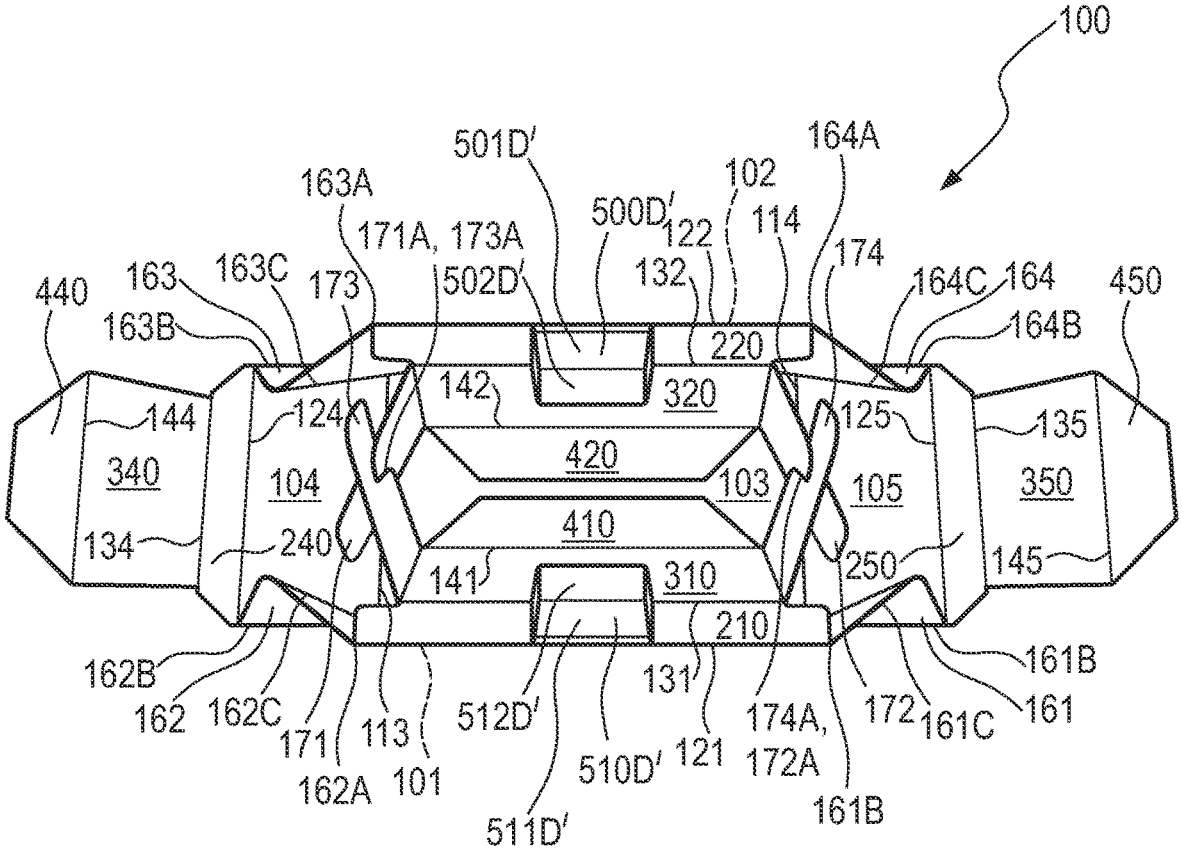
FIG. 12 provides a front view of the blank of FIG. 11 with the respective fitting pieces connected to each other.

The left fitting piece 171 of the outer upper panel 320 may connect with the left fitting piece 173 of the outer lower panel 310 by inserting the insertion slot 171A of the left fitting piece 171 of the outer upper panel 320 into the insertion slot 173A of the left fitting piece 173 of the outer lower panel 310, as shown in FIG. 12 for instance.

Likewise, the right fitting piece 172 of the outer upper panel 320 may connect with the right fitting piece 174 of the outer lower panel 310, by inserting the insertion slot 172A of the right fitting piece 172 of the outer upper panel 320 into the insertion slot 174A of the right fitting piece 174 of the outer lower panel 310, as shown in FIG. 12 for instance.

Figure 13:
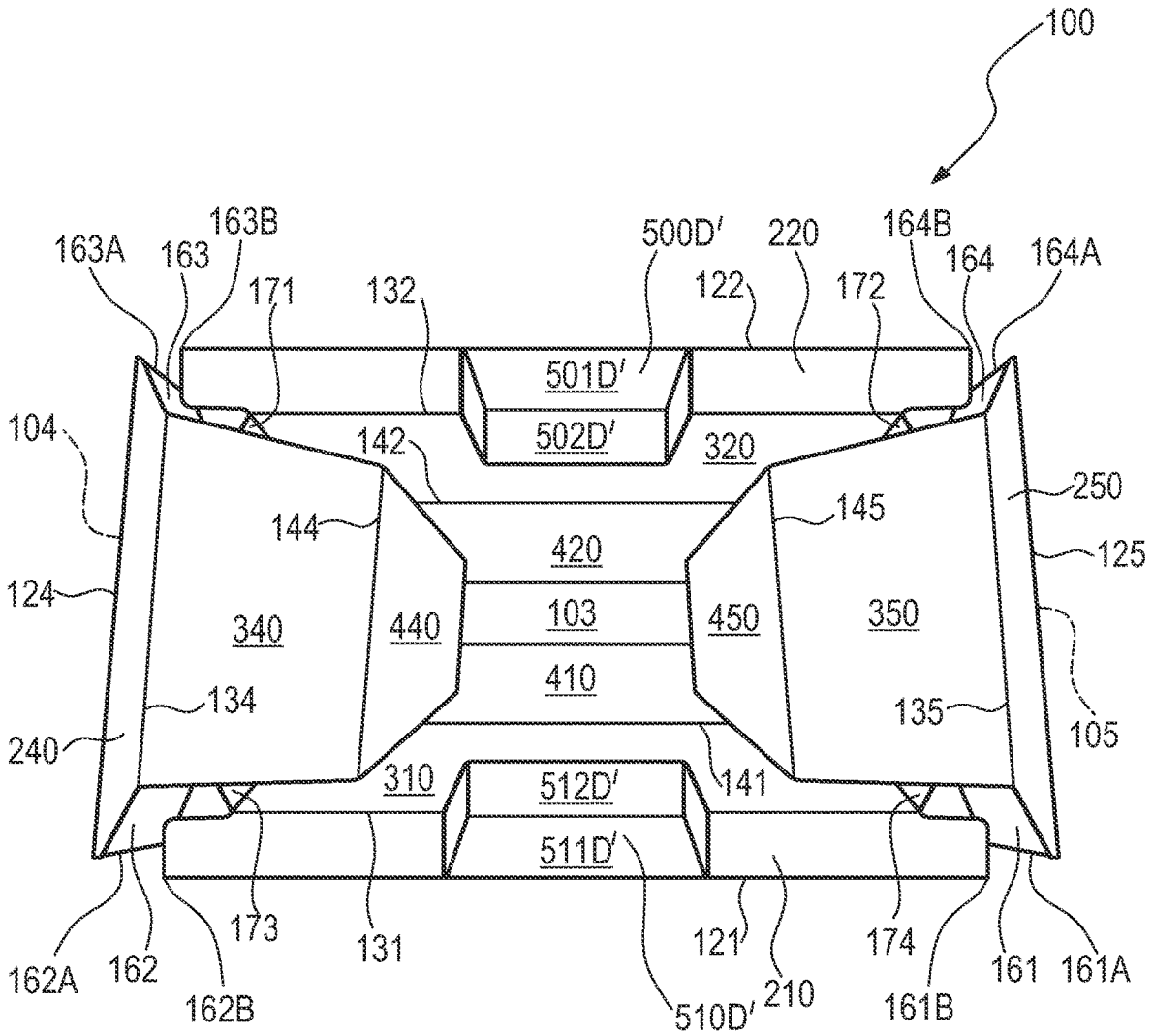
FIG. 13 provides a front view of the partially folded blank of FIG. 9.

Then, the outer left panel 340 needs to be folded onto the left panel 104 by folding the fifth fold line 124 of the left panel 104 and the sixth fold line 134 of the outer left panel 340. The outer right panel 350 needs to be folded onto the right panel 105 by folding the seventh fold line 125 of the right panel 105 and the eighth fold line 135 of the outer right panel 350, as shown in FIG. 13 for instance.

At the same time, first, second, third and fourth continuous pieces (161, 162, 163, 164) will fold on their respective 45-degree valley fold lines (161C, 162C, 163C, 164C). Such folding of the continuous pieces (161, 162, 163, 164) can help to close up the edges of the cardboard box 10 to render it hermetic, as shown in FIGS. 10-14 for instance.

Figure 14:
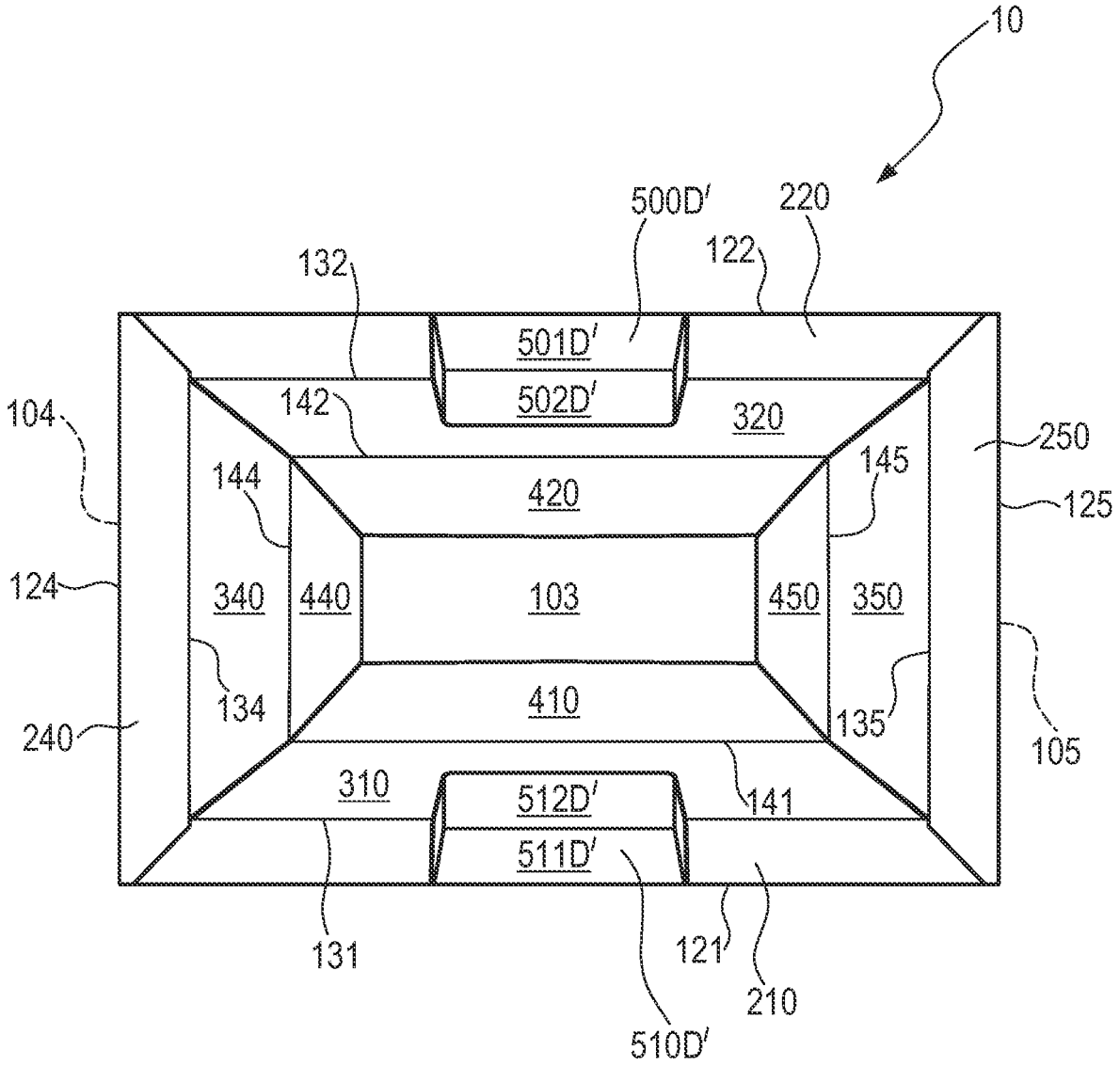
FIG. 14 provides a front view of the fully folded blank of FIG. 9.

Optionally, as shown in FIG. 14, for instance, when the blank 100 is folded into the cardboard box 10, the blank 100 may comprise an inner peripheral bottom frame 40 located in the cavity part 30 at the bottom wall 13 that includes a front tongue portion 41, a rear tongue portion 42, opposite left and right tongue portions (43, 44).

The inner peripheral bottom frame 40 may be obtained by folding the respective folding locking piece 410 of the outer lower panel 310 onto the outer lower panel 310, the folding locking piece 420 of the outer upper panel 320 onto the outer upper panel 320, the folding locking piece 440 of the outer left panel 340 onto the outer left panel 340 and the folding locking piece 450 of the outer right panel 350 onto the outer right panel 350.

Sleeve Cover

The soap package 1 may include a sleeve cover 20 to close the cardboard box 10 in order to protect the soap 60 from the external environment.

Figure 15:
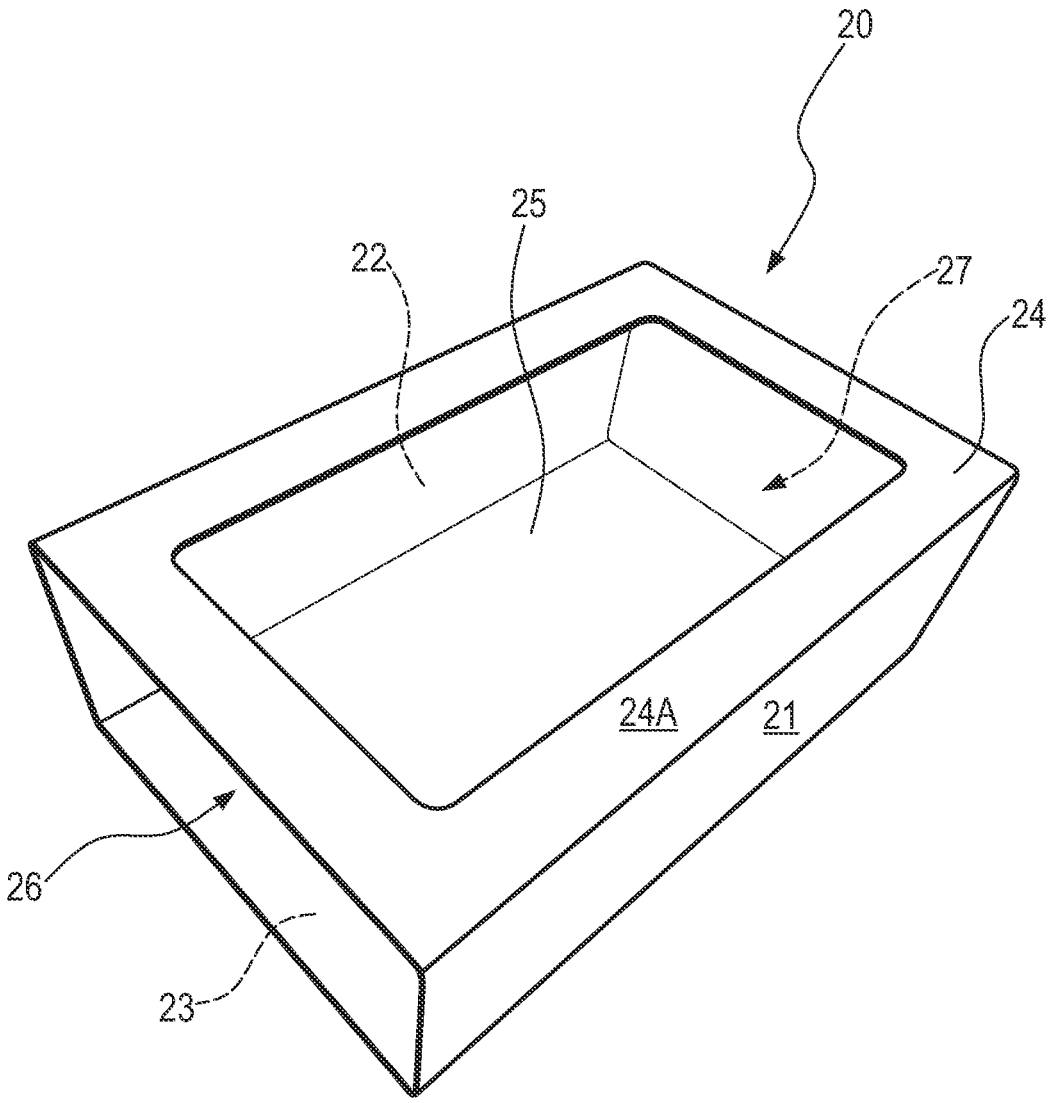
FIG. 15 provides a perspective view of an exemplary sleeve cover.

FIG. 15 provides a schematic perspective view of a sleeve cover according to one or more aspects.

Figure 16:
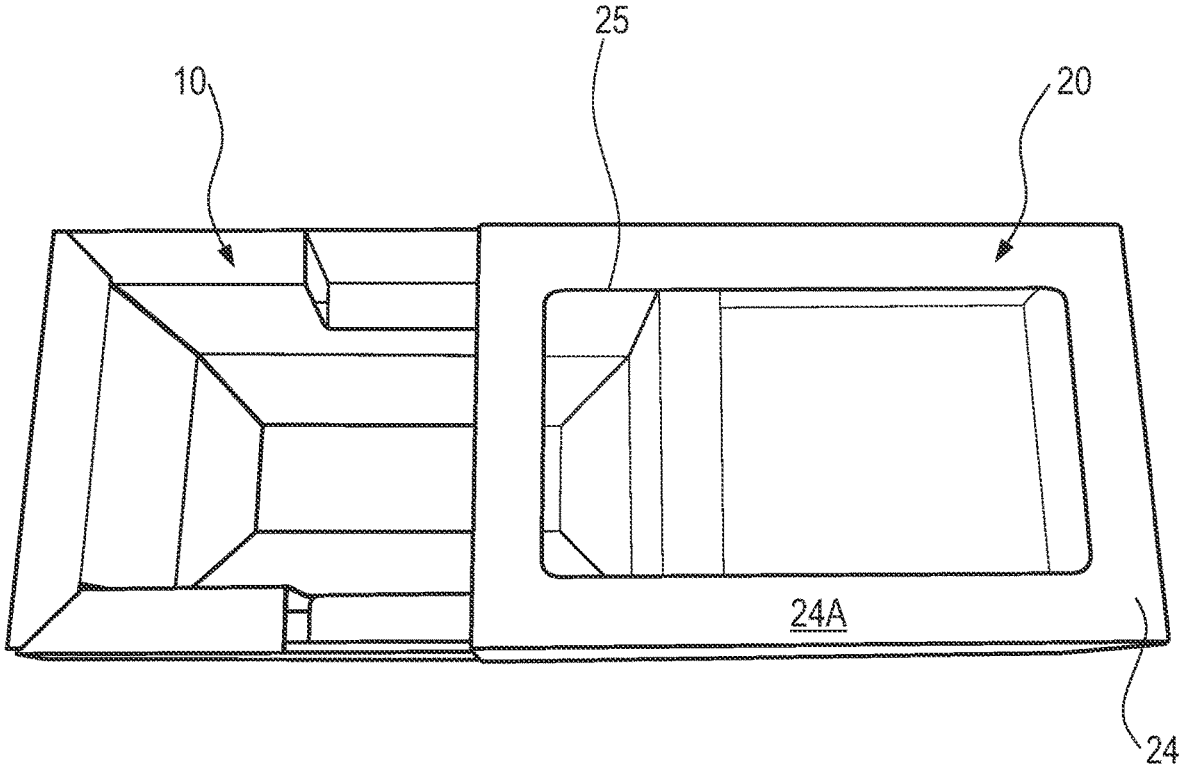
FIG. 16 provides a perspective view of an exemplary cardboard box and sleeve cover.
Figure 17:
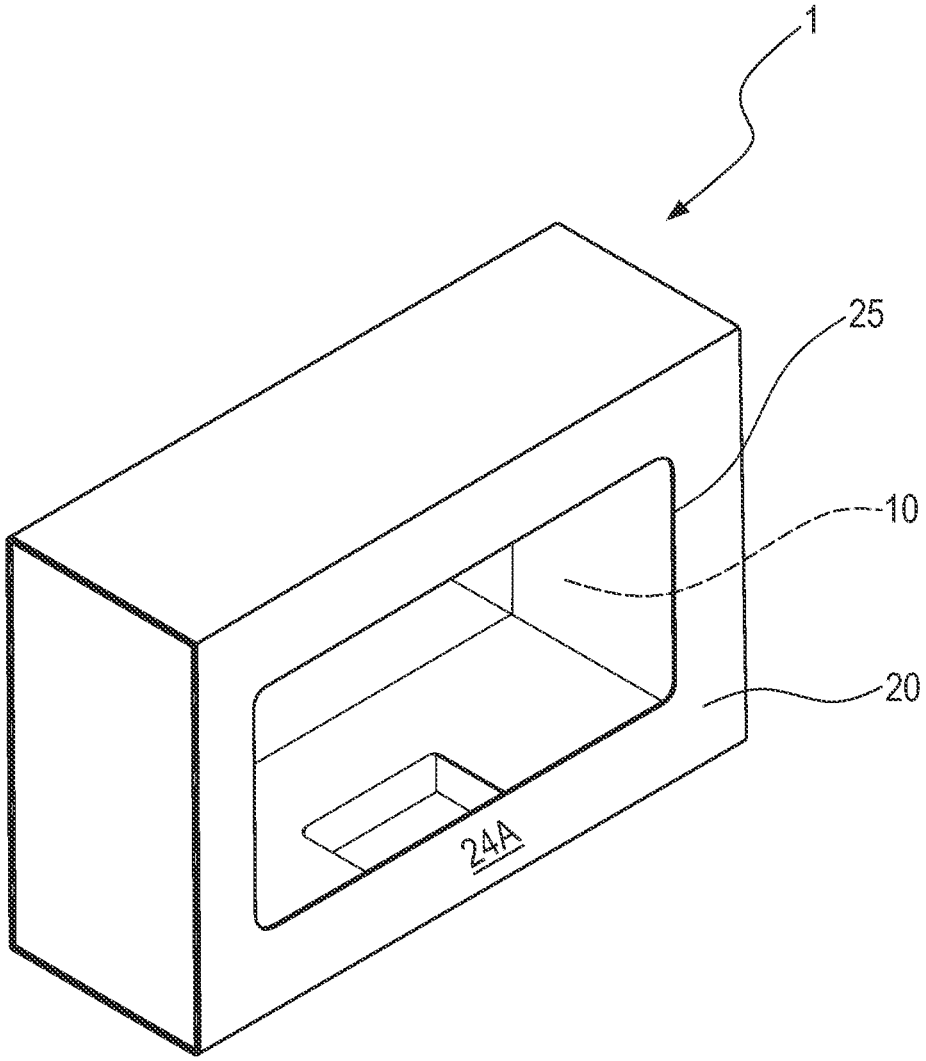
FIG. 17 provides a perspective view of an exemplary soap package with a sleeve cover.
Figure 18:
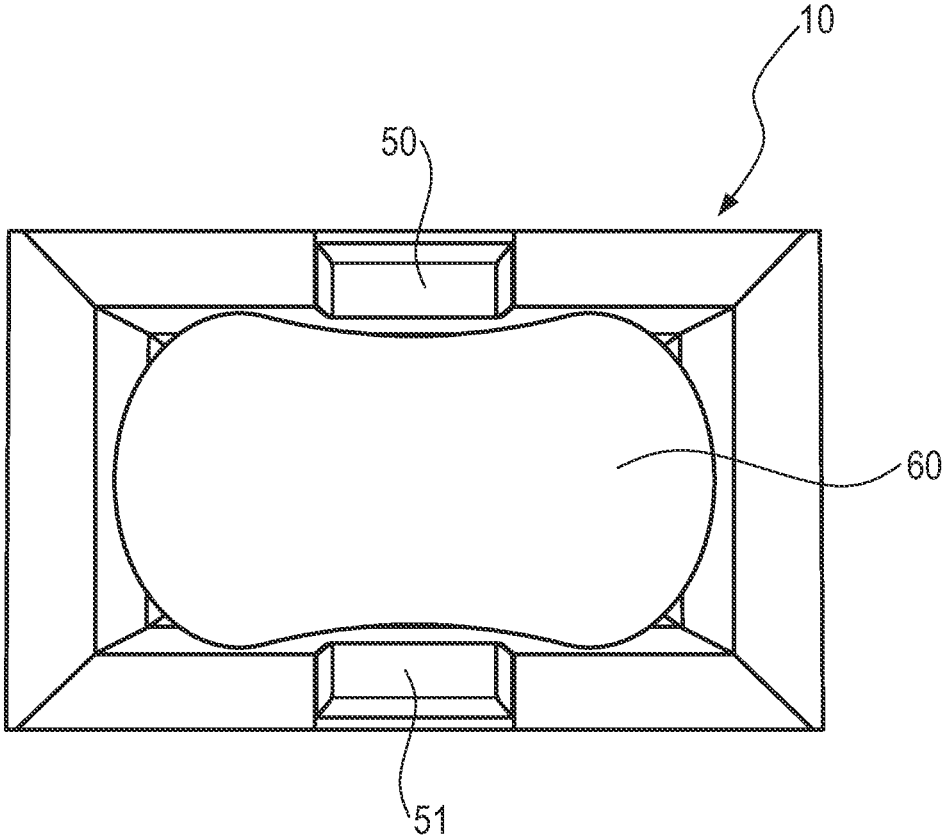
FIG. 18 provides a top view of an exemplary soap package comprising a cardboard box and soap.
Figure 19:
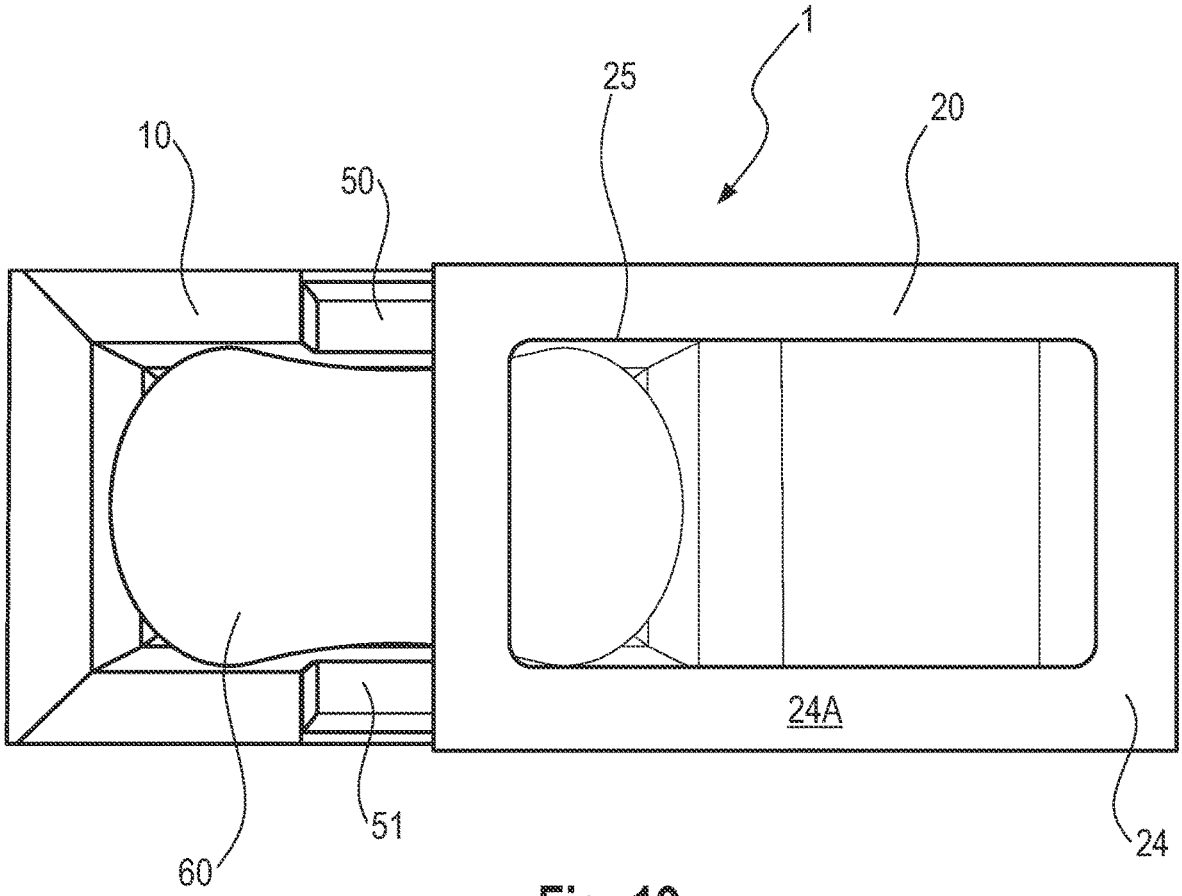
FIG. 19 provides a top view of the soap package of FIG. 18 with the sleeve cover partially withdrawn.

The sleeve cover 20 may comprise a front wall 21, a rear wall 22, a top wall 24, and a bottom wall 23. The sleeve cover 20 may comprise open opposite left and right sides (26, 27) such that open opposite left and right sides (26, 27) can be either used as openings to insert the cardboard box 10 into the sleeve cover 20, as shown for instance in FIG. 16.

The sleeve cover 20 may advantageously comprise a window 25 located on the top wall 24 of the sleeve cover 20.

Preferably, the window 25 of the sleeve cover 20 may be centered on the top wall 24 such that the soap 60 is visible from the window 25 when the cardboard box 10 is closed by the sleeve cover 20 as shown for instance in FIGS. 17-20.

Figure 20:
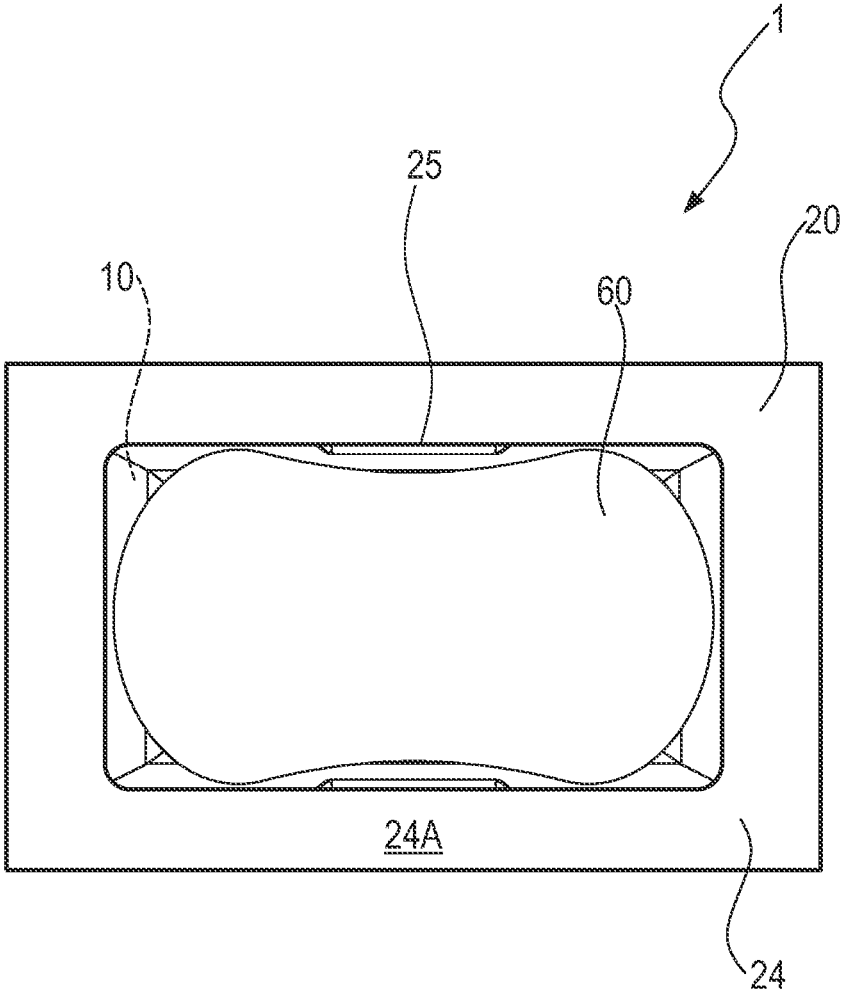
FIG. 20 provides a top view of the soap package of FIG. 18 with a sleeve cover.

The sleeve cover 20 may have an outer frame 24A of the top wall 24 defined by the window 25. The outer frame 24A of the top wall 24 may be dimensioned such that the outer frame 24A hides the first and second finger hook parts (50, 51) but not the narrow centered portion 61 of the soap 60 when the cardboard box 10 is closed by the sleeve cover 20, as shown in FIG. 20 for instance.

The outer frame 24A of the top wall 24 may have a parallelepiped-shape. Alternatively, the outer frame 24A of the top wall 24 may also comprise one or more curve portions.

Figure 21:
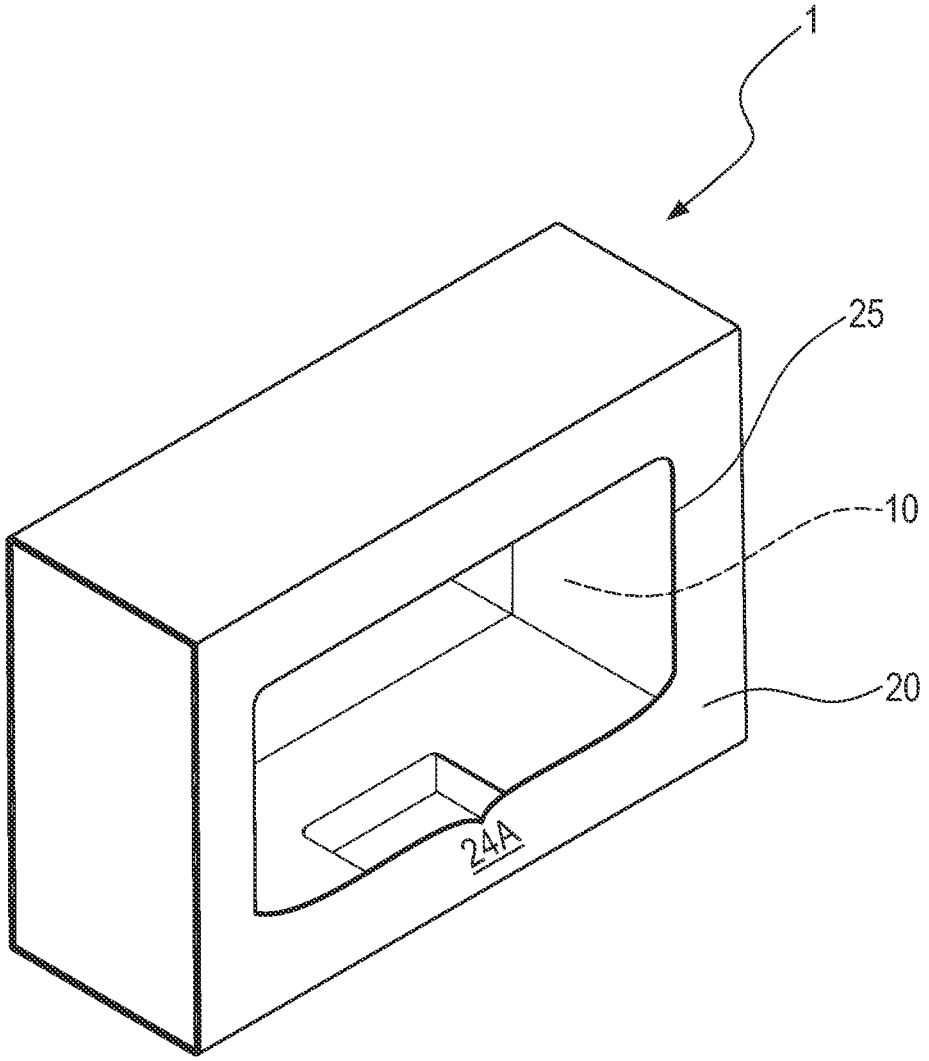
FIG. 21 provides a perspective view of an exemplary soap package.

FIG. 21 provides a schematic perspective view of a soap package when closed by another sleeve cover having an outer frame with curved portions.

Lid Cover

Alternatively, the soap package 1 may include a lid cover to close the cardboard box 10 in order to protect the soap 60 from the external environment.

The lid may be continuous with the rear wall 12 along a hinge line and is overlaying the top frame 16. Hence, the cardboard box 10 can be easily opened and re-closed by a user.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A soap package comprising a cardboard box for packaging the soap, the box comprising:

a front wall, a rear wall, a bottom wall, opposing left and right side walls, and a top frame, wherein the top frame includes a front frame portion, a rear frame portion, and opposing left and right front frame portions;

a longitudinal axis parallel to the front and rear walls;

a transversal axis perpendicular to the longitudinal axis;

a cavity part configured to hold the soap, wherein the cavity part comprises an inner front wall, an inner rear wall, opposite inner left and right side walls, an inner peripheral bottom frame, wherein the inner peripheral bottom frame is located in the cavity part at the bottom wall; and first and second finger hook parts, wherein the first finger hook part is located at the inner rear wall and extends from the rear wall, and the second finger hook part is located at the inner front wall and extends from the front wall; and a soap, wherein the soap comprises a narrow centered portion that matches with first and second finger hook parts of the box thereby enabling a user to grasp the soap out of the box.

2. The soap package of claim 1, wherein the cardboard box is formed from a blank comprising:

a front panel to form the front wall, a rear panel to form the rear wall, wherein the front panel is opposite to the rear panel, a bottom panel to form the bottom wall, opposite left and right panels to form the respective opposite left and right side walls, opposite outer left and right panels to form the respective opposite inner left and right side walls, opposite outer upper and lower panels to form respectively the inner rear wall and the inner rear front;

wherein the bottom panel and the front panel are connected at a first fold line, wherein the bottom panel and the rear panel are connected at a second fold line, wherein the bottom panel and the left panel are connected at a third fold line, wherein the bottom panel and the right panel are connected at a fourth fold line;

wherein the left panel has a flap opposite to the bottom panel and connected to the left panel at a fifth fold line; wherein the outer left panel is connected to the flap of the left panel at a sixth fold line, wherein the flap forms the left frame portion of the top frame;

wherein the right panel has a flap opposite to the bottom panel and connected to the right panel at a seventh fold line; wherein the outer right panel is connected to the flap of the right panel at an eighth fold line, wherein the flap forms the right frame portion of the top frame;

wherein the third, fourth, fifth, sixth, seventh and eighth fold lines are parallel lines;

wherein the front panel has a flap opposite to the bottom panel and connected to the front panel at a ninth fold line; wherein the outer lower panel is connected to the flap of the front panel at a tenth fold line, wherein the flap forms the front frame portion of the top frame;

wherein the rear panel has a flap opposite to the bottom panel and connected to the rear panel at an eleventh fold line, wherein the outer upper panel is connected to the flap of the rear panel at a twelfth fold line, wherein the flap forms the rear frame portion of the top frame;

wherein the first, second, ninth, tenth, eleventh and twelfth fold lines are parallel lines.

3. The soap package of claim 2, wherein the blank further includes first, second, third and fourth continuous pieces, wherein the first continuous piece connects the front panel and the right panel with two respective fold lines and wherein the first continuous piece has a 45-degree valley fold line between the front panel and the right panel;

wherein the second continuous piece connects the front panel and the left panel with two respective fold lines and wherein the second continuous piece has a 45-degree valley fold line between the front panel and the left panel;

wherein the third continuous piece connects the rear panel and the left panel with two respective fold lines and wherein the third continuous piece has a 45-degree valley fold line between the rear panel and the left panel;

wherein the fourth continuous piece connects the rear panel and the right panel with two respective fold lines and wherein the fourth continuous piece has a 45-degree valley fold line between the rear panel and the right panel.

4. The soap package of claim 2, wherein the blank further includes at each of the outer opposite upper and lower panels, two respective opposite left and right fitting pieces, wherein each of the respective opposite left and right fitting pieces comprises an insertion slot such that when the blank is folded into the box:

the left fitting piece of the outer upper panel connects with the left fitting piece of the outer lower panel by inserting the insertion slot of the left fitting piece of the outer upper panel into the insertion slot of the left fitting piece of the outer lower panel; and the right fitting piece of the outer upper panel connects with the right fitting piece of the outer lower panel, by inserting the insertion slot of the right fitting piece of the outer upper panel into the insertion slot of the right fitting piece of the outer lower panel.

5. The soap package of claim 2, wherein the outer left panel has a folding locking piece to form a left tongue portion of the inner peripheral bottom frame, wherein the folding locking piece is connected at the outer left panel at a fold line;

wherein the outer right panel has a folding locking piece to form a right tongue portion of the inner peripheral bottom frame, wherein the folding locking piece is connected at the outer right panel at a fold line;

wherein the outer lower panel has a folding locking piece to form a front tongue portion of the inner peripheral bottom frame, wherein the folding locking piece is connected at the outer lower panel at a fold line;

wherein the outer upper panel has a folding locking piece to form a rear tongue portion of the inner peripheral bottom frame, wherein the folding locking piece is connected at the outer upper panel at a fold line.

6. The soap package of claim 1, wherein the first finger hook part is an aperture formed by a complete rectangular notch provided on a portion of the rear wall and the rear frame portion, and a complete lower arc-shaped notch provided on a portion of the inner rear wall, wherein the complete rectangular notch at the rear frame portion is connected to the complete lower arc-shaped notch at the inner rear wall; and wherein the second finger hook part is an aperture formed by a complete rectangular notch provided on a portion of the top wall and the top frame portion, and a complete lower arc-shaped notch provided on a portion of the inner front wall wherein the complete rectangular notch at the top frame portion is connected to the complete lower arc-shaped notch at the inner front wall.

7. The soap package of claim 6, wherein the blank includes a first aperture to form the first finger hook part, wherein the first aperture is a cutting notch formed by a complete rectangular notch provided at a portion of the rear panel and a portion of the flap of the rear panel, and a complete lower arc-shaped notch provided on a portion of the outer upper panel, wherein the complete rectangular notch at the flap of the rear panel is connected to the complete lower arc-shaped notch at the outer upper panel; and wherein the blank includes a second aperture to form the second finger hook part, wherein the second aperture is a cutting notch formed by a complete rectangular notch provided at a portion of the front panel and a portion of the flap of the front panel, and a complete lower arc-shaped notch provided on a portion of the outer lower panel, wherein the complete rectangular notch at the flap of the front panel is connected to the complete lower arc-shaped notch at the outer lower panel.

8. The soap package of claim 1, wherein the first finger hook part comprises a cutting notch and a reflexed cutout, wherein the reflexed cutout comprises upper and lower cutout portions;

wherein the upper cutout portion of the first finger hook part is formed by a rectangular notch provided on a portion of the rear frame portion, and wherein the lower cutout portion of the first finger hook part is formed by a lower arc-shaped notch provided on a portion of the inner rear wall, wherein the upper cutout portion and lower cutout portion are connected as a whole; and wherein the second finger hook part comprises a cutting notch and a reflexed cutout, wherein the reflexed cutout comprises upper and lower cutout portions;

wherein the upper cutout portion of the second finger hook part is formed by a rectangular notch provided on a portion of the front frame portion, and wherein the lower cutout portion of the second finger hook part is formed by a lower arc-shaped notch provided on a portion of the inner front wall, wherein the upper cutout portion and lower cutout portion are connected as a whole.

9. The soap package of claim 8, wherein the blank includes a first cutout to form the first finger hook part, wherein the first cutout includes first and second cutout portions;

wherein the first cutout portion is formed by cutting two parallel line segments both extending and perpendicular from the eleventh fold line of the rear panel to a portion of the outer upper panel;

wherein the second cutout portion is formed by cutting two opposite arcs extending from the respective parallel line segments at the outer upper panel;

wherein the first cutout comprises first, second and third fold lines, wherein the first fold line of the first cutout is coincident to the eleventh fold line of the rear panel, wherein the second fold line of the first cutout connects the two parallel line segments, wherein the third fold line of the first cutout connects the two opposite arcs, and wherein the first fold line is parallel to the second and third fold lines of the first cutout;

wherein the blank includes a second cutout to form the second finger hook part, wherein the second cutout includes first and second cutout portions;

wherein the first cutout portion is formed by cutting two parallel line segments both extending and perpendicular from the ninth fold line of the front panel to a portion of the outer lower panel;

wherein the second cutout portion is formed by cutting two opposite arcs extending from the respective parallel line segments at the outer lower panel;

wherein the second cutout comprises first, second and third fold lines, wherein the first fold line of the second cutout is coincident to the ninth fold line of the front panel, wherein the second fold line of the second cutout connects the two parallel line segments, wherein the third fold line of the second cutout connects the two opposite arcs, and wherein the first fold line is parallel to the second and third fold lines of the second cutout.

10. The soap package of claim 1, wherein the first finger hook part comprises a cutting notch and a reflexed cutout, wherein the reflexed cutout comprises upper and lower cutout portions;

wherein the upper cutout portion of the first finger hook part is formed by a rectangular notch provided on a portion of the rear frame portion, and wherein the lower cutout portion of the first finger hook part is formed by a rectangular notch provided on a portion of the inner rear wall extending from an upper longitudinal edge to a lower longitudinal edge of the inner rear wall, wherein the upper cutout portion and lower cutout portion are connected as a whole; and wherein the second finger hook part comprises a cutting notch and a reflexed cutout, wherein the reflexed cutout comprises upper and lower cutout portions;

wherein the upper cutout portion of the second finger hook part is formed by a rectangular notch provided on a portion of the front frame portion, and wherein the lower cutout portion of the second finger hook part is formed by a rectangular notch provided on a portion of the inner front wall extending from an upper longitudinal edge to a lower longitudinal edge of the inner front wall, wherein the upper cutout portion and lower cutout portion are connected as a whole.

11. The soap package of claim 10, wherein the blank includes a first cutout to form the first finger hook part, wherein the first cutout includes first and second cutout portions;

wherein first and second cutout portions are formed by cutting two parallel line segments both extending and perpendicular from the eleventh fold line of the rear panel to an opposite edge of the outer upper panel;

wherein the first cutout comprises first, second and third fold lines, wherein the first fold line of the first cutout is coincident to the eleventh fold line of the rear panel, wherein the second fold line of the first cutout connects first and second cutout portions, wherein the third fold line of the first cutout is coincident to the opposite edge of the outer upper panel, and wherein the first fold line is parallel to the second and third fold lines of the first cutout;

wherein the blank includes a second cutout to form the second finger hook part, wherein the second cutout includes first and second cutout portions;

wherein the second cutout portion is formed by cutting two parallel line segments both extending and perpendicular from the ninth fold line of the front panel to an opposite edge of the outer lower panel;

wherein the second cutout comprises first, second and third fold lines, wherein the first fold line of the second cutout is coincident to the ninth fold line of the front panel, wherein the second fold line of the second cutout connects first and second cutout portions, wherein the third fold line of the second cutout is coincident to the opposite edge of the outer lower panel, and wherein the first fold line is parallel to the second and third fold lines of the second cutout.

12. The soap package of claim 1, wherein the first finger hook part comprises a cutting notch and a reflexed cutout, wherein the reflexed cutout comprises upper and lower cutout portions;

wherein the upper cutout portion of the first finger hook part is formed by a rectangular notch provided on a portion of the rear frame portion, and wherein the lower cutout portion of the first finger hook part is formed by a rectangular notch provided on a portion of the inner rear wall, wherein the upper cutout portion and lower cutout portion are connected as a whole; and wherein the second finger hook part comprises a cutting notch and a reflexed cutout, wherein the reflexed cutout comprises upper and lower cutout portions;

wherein the upper cutout portion of the second finger hook part is formed by a rectangular notch provided on a portion of the front frame portion, and wherein the lower cutout portion of the second finger hook part is formed by a rectangular notch provided on a portion of the inner front wall, wherein the upper cutout portion and lower cutout portion are connected as a whole.

13. The soap package of claim 12, wherein the blank includes a first cutout to form the first finger hook part, wherein the first cutout includes first and second cutout portions;

wherein first and second cutout portions are formed by cutting two parallel line segments both extending and perpendicular from the eleventh fold line of the rear panel to a portion of the outer upper panel;

wherein the first cutout comprises first, second and third fold lines, wherein the first fold line of the first cutout is coincident to the eleventh fold line of the rear panel, wherein the second fold line of the first cutout connects first and second cutout portions, wherein the third fold line of the first cutout is an outmost edge of the second cutout portion, and wherein the first fold line is parallel to the second and third fold lines of the first cutout;

wherein the blank includes a second cutout to form the second finger hook part, wherein the second cutout includes first and second cutout portions;

wherein the second cutout portion is formed by cutting two parallel line segments both extending and perpendicular from the ninth fold line of the front panel to a portion of the outer lower panel;

wherein the second cutout comprises first, second and third fold lines, wherein the first fold line of the second cutout is coincident to the ninth fold line of the front panel, wherein the second fold line of the second cutout connects first and second cutout portions, wherein the third fold line of the second cutout is an outmost edge of the second cutout portion of the outer lower panel, and wherein the first fold line is parallel to the second and third fold lines of the second cutout.

14. The soap package of claim 1 wherein the narrow centered portion of the soap is defined as the centered region of soap extending along the longitudinal axis and having a relatively narrow width as measured in the transversal direction perpendicular to the longitudinal axis.

15. The soap package of claim 1, wherein the soap package comprises a sleeve cover to close the cardboard box;

wherein the sleeve cover comprises a front wall, a rear wall, a top wall, a bottom wall, wherein the sleeve cover comprises open opposite left and right sides, wherein the sleeve cover comprises a window located on the top wall of the sleeve cover.

* * * * *